US007055941B2

(12) United States Patent
Tsurui et al.

(10) Patent No.: US 7,055,941 B2
(45) Date of Patent: Jun. 6, 2006

(54) LIQUID STORAGE CONTAINER, AND LIQUID DISCHARGE RECORDING APPARATUS USING THE CONTAINER

(75) Inventors: Norio Tsurui, Kanagawa (JP); Hajime Yamamoto, Tokyo (JP); Nobuyuki Hatasa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 10/775,094

(22) Filed: Feb. 11, 2004

(65) Prior Publication Data

US 2004/0160496 A1 Aug. 19, 2004

(30) Foreign Application Priority Data

Feb. 14, 2003 (JP) ..... 2003-036093
May 23, 2003 (JP) ..... 2003-146064

(51) Int. Cl.
*B41J 2/175* (2006.01)
*B67D 37/00* (2006.01)

(52) U.S. Cl. ..... 347/86; 222/211

(58) Field of Classification Search ..... 347/85, 347/86, 87; 222/211
See application file for complete search history.

(56) References Cited

U.S. PATENT DOCUMENTS 2,859,899 A * 11/1958 Kramer et al. ..... 222/95
3,240,399 A * 3/1966 Frandeen ..... 222/211
3,896,970 A * 7/1975 Laauwe ..... 222/94
4,159,790 A * 7/1979 Bailey ..... 222/211
4,809,884 A * 3/1989 Stackhouse ..... 222/153.04
5,305,921 A * 4/1994 Kock et al. ..... 222/95
6,726,315 B1 * 4/2004 Koizumi et al. ..... 347/85
6,799,841 B1 * 10/2004 Goto et al. ..... 347/85
2002/0109758 A1 8/2002 Kono ..... 347/85

FOREIGN PATENT DOCUMENTS

JP 2001-1543 1/2001
JP 2001-270131 10/2001
JP 2001-293880 10/2001

* cited by examiner

*Primary Examiner*—Anh T. N. Vo
(74) *Attorney, Agent, or Firm*—Fitzpatrick, Cella, Harper & Scinto

(57) ABSTRACT

A liquid storage container comprises a liquid storage part for storing a liquid, a connection part for taking out the liquid, provided in the bottom part of the liquid storage part, and a pipe provided in the liquid storage part so as to cover the opening of the connection part on the liquid storage part side, wherein a plurality of liquid inlet holes are formed in the pipe, each communicating with the liquid storage part at a plurality of positions in the vertical direction, and the inlet resistance of the liquid inlet holes disposed in the lower layer area out of the plurality of the liquid inlet holes of the pipe is larger than the inlet resistance of the other liquid inlet holes.

7 Claims, 11 Drawing Sheets

LIQUID STORAGE CONTAINER, AND LIQUID DISCHARGE RECORDING APPARATUS USING THE CONTAINER

BACKGROUND OF THE INVENTION

1. Field of the Invention

The present invention relates to a replaceable liquid storage container suitable for the use in an ink jet recording apparatus, or the like, and a liquid discharge recording apparatus using the container. Specifically, it relates to a liquid storage container for storing a dispersion type ink (liquid) such as a pigment, and a liquid discharge recording apparatus using the container.

2. Related Background Art

The ink jet recording method is for executing a desired recording operation by jumping ink droplets from a minute ejection opening provided in an ink jet head, and having the ink droplets impact on a recording medium.

As an ink used for the ink jet recording, a liquid using a dye has mainly been used. However, according to a recorded matter recorded with a liquid using a dye, the performance required for the applications regarding the light resistance and the weather resistance important, such as the exterior display printed matter, or the like cannot be provided, and thus a liquid using a pigment is used instead thereof.

Since the pigment is not a dissolution type but a dispersion type, according to an ink (liquid) using a pigment, pigment particles are precipitated in an ink tank as a liquid storage part.

In the case of an out carriage tank with an ink tank fixed statically (such as a main tank used for a recording apparatus disclosed in the specification of the U.S. Patent Application Disclosure No. 2002/109758, or the like), it has been revealed that the pigment precipitation phenomenon cannot be ignored depending on the use frequency, the use interval, the number of recording (number of recorded sheets), or the like of the recording apparatus. Particularly in the case of the out carriage tank, the ink capacity tends to be made larger for the purpose of reducing the replacement frequency of the ink tank as the liquid storage container for the user with the need of high user frequency. Also in this regard, there has been the concern about the pigment precipitation not to be ignorable for the user.

For example, in the case the ink tank is left for a long time in a state mounted on the ink jet recording apparatus, the pigment particles are gradually precipitated inside the ink tank. As a result, the density inclination of the pigment particles is generated from the bottom part to the upper part inside the ink tank (liquid storage container) so that a layer with a high pigment particle density having an excessively thick color is generated in the bottom part, and a layer with a low pigment density having an excessively thin color is generated in the upper part.

Then, in the case an ink is supplied from the ink tank having a configuration of guiding out the ink in the ink storage chamber from the ink tank bottom part, since the ink is supplied first from the layer with the high pigment particle density, a problem (technological task) is involved in that a printed matter with an excessively thick color is produced, and then the density difference to the degree visually recognizable is generated in the printed matters between the use initial stage and the use latter stage of the ink tank. This phenomenon becomes particularly remarkable in the color printing for providing an image by the color thickness.

In order to solve the technological task, for example, as it is disclosed in the Japanese Patent Application Laid Open (JP-A) Nos. 2001-270131 and 2001-293880, a tube-like pipe with a plurality of holes is provided in an ink tank from the ink supply opening of the ink tank so that the ink is vacuumed not only from the part in the vicinity of the ink supply opening inside the ink tank but also from a large number of portions in the vertical direction in the ink tank, wherein a portion for temporarily storing the ink vacuumed from the large number of the portions is provided such that the density irregularity of the ink in the vertical direction being left for a long time in the ink tank can be alleviated by supplying the ink from the storing portion.

However, since the relationship with respect to the pigment precipitation characteristic is not taken into consideration in the holes provided in the tube-like pipe of the ink tank disclosed in the above-mentioned Japanese Patent Application Laid-Open (JP-A) Nos. 2001-270131 and 2001-293880, the density and the mount of the ink flown in from the outside of the tube-like pipe through the holes provided in the tube-like pipe are not administered so that the ink density in the tube-like pipe becomes consequently different from the original ink density, and thus the problem of generation of the density difference in the recorded matters in the use initial stage and the use latter stage of the ink tank had not been solved sufficiently.

Moreover, as means for solving the coloring material precipitation, there is a method of providing propeller-like agitating means and driving means for rotating the same inside a main tank for rotating the agitating means regularly at a predetermined rate. However, the agitating mechanism is extremely expensive. Moreover, in the case the driving means (motor) is provided in the vicinity of an ink channel, a leaked ink adhered on a power source connector part of the driving motor can be the cause of breakdown such as short circuit so that there is the risk of leading to generation of smoke, fire, or the like.

SUMMARY OF THE INVENTION

The present invention has been achieved in order to solve the above-mentioned conventional problems, and an object thereof is to provide a liquid storage container for storing a liquid containing a content such as a pigment as a coloring agent, capable of maintaining the density of the liquid to be taken out at a value close to the initial density even in the case the content is precipitated according to the time passage, and capable of maintaining a predetermined recording density by preventing the density variance of the recorded matter even in the case of use over a long term in a recording apparatus, or the like, and a recording apparatus using the storage container.

In order to achieve the above-mentioned object, a liquid storage container according to the present invention comprises a liquid storage part for storing a liquid, a connection part for taking out the liquid, provided in the bottom part of the liquid storage part, and a pipe provided in the liquid storage part so as to cover the opening of the connection part on the liquid storage part side, wherein a plurality of liquid inlet holes are formed in the pipe, each communicating with the liquid storage part at a plurality of positions in the vertical direction, and the inlet resistance of the liquid inlet holes disposed in the lower layer area on the bottom part side out of the plurality of the liquid inlet holes of the pipe is larger than the inlet resistance of the other liquid inlet holes.

Moreover, a liquid storage container of another aspect of the present invention comprises a liquid storage part for storing a liquid, a connection part for taking out the liquid, provided in the bottom part of the liquid storage part, and a pipe provided in the liquid storage part so as to cover the opening of the connection part on the liquid storage part side, wherein a plurality of liquid inlet holes are formed in the pipe, each communicating with the liquid storage part at a plurality of positions in the vertical direction, and the hole diameter of the plurality of the liquid inlet holes of the pipe is set such that the liquid inlet amount from each inlet hole into the pipe becomes substantially equal.

According to the above-mentioned liquid storage container, a liquid storage container for storing a liquid containing a content such as a pigment as a coloring agent, capable of maintaining the density of the liquid to be taken out at a value close to the initial density even in the case the content is precipitated according to the time passage, and capable of maintaining a predetermined recording density by preventing the density variance of the recorded matter even in the case of use over a long term in a recording apparatus, or the like, and a recording apparatus using the storage container, can be provided.

DETAILED DESCRIPTION OF THE PREFERRED EMBODIMENTS

Hereinafter, with reference to the drawings, the embodiments of the present invention will be explained specifically.

Figure 1:
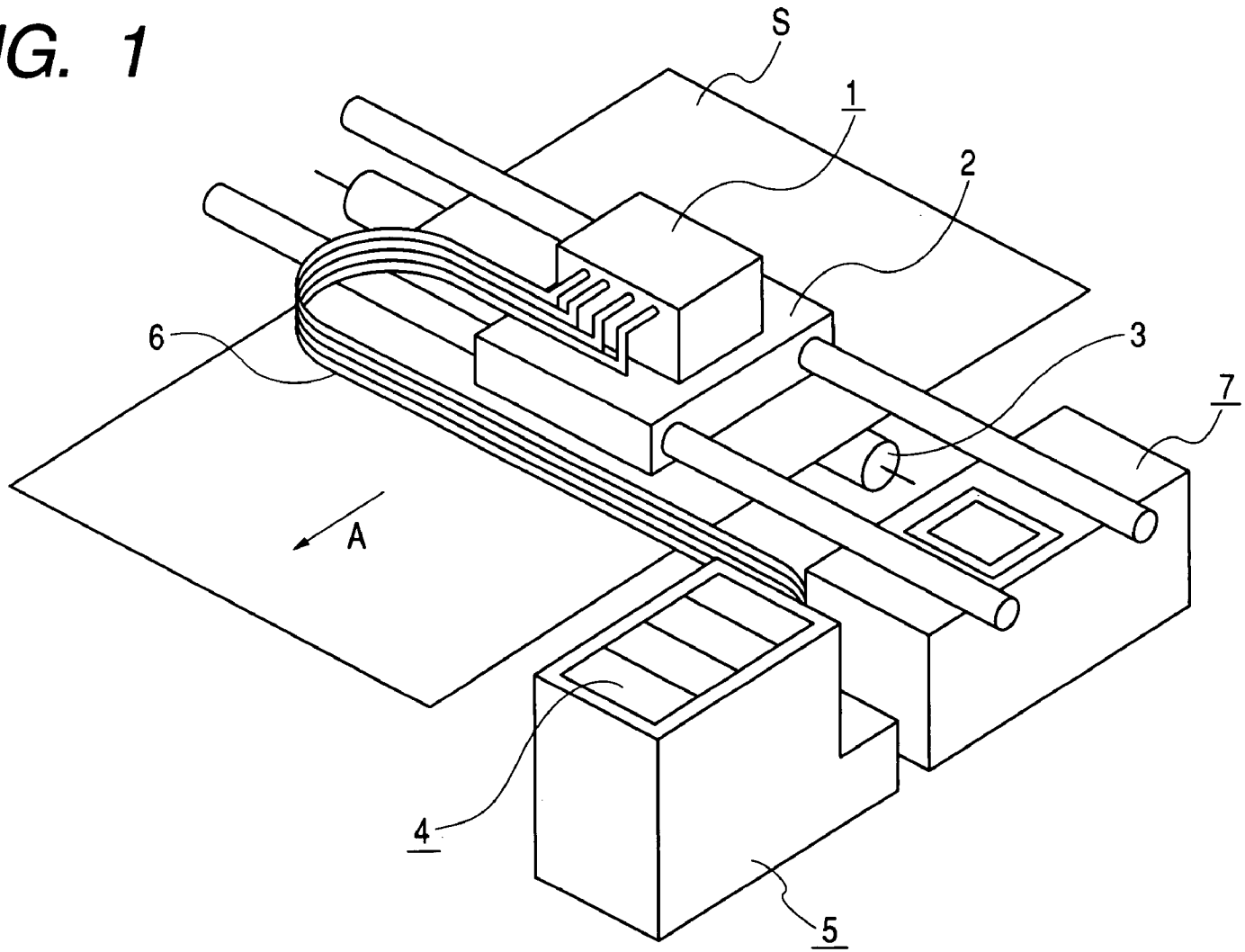
FIG. 1 is a perspective view showing a liquid discharge recording apparatus capable of adopting the present invention.

FIG. 1 is a perspective view showing a recording apparatus capable of mounting a liquid storage container of the present invention. In FIG. 1, an ink jet recording apparatus for recording an image by ejecting an ink onto a recording medium S having a recording head 1 for ejecting the ink on a carriage 2, conveys the recording medium S in the conveying direction A (sub scanning direction) by a conveying roller 3, and moves the carriage reciprocally in the direction B orthogonal to the sub scanning direction (main scanning direction). The recording medium S is conveyed in the sub scanning direction by a predetermined pitch by the conveying roller 3 such that the scanning operation is executed by the carriage 2 in the main scanning direction while ejecting the ink from the recording head 1 per each pitch of the recording medium S.

A plurality of nozzle rows comprising ejecting nozzles in series in the sub scanning direction are provided on the surface of the recording head 1 facing the recording medium S so as to eject the different inks for each nozzle row. A set of ink supply system is provided for each color nozzle row. The ink supply system comprises a main tank (liquid storage container) 4 for storing the ink, an ink supply unit 5 for supporting the main tank (liquid storage container) 4, and an ink supply tube 6 for guiding the ink from the ink supply unit 5 to the nozzle row. The ink supply unit 5 supplies the ink from the main tank (liquid storage container) 4 to the ink supply tube 6.

The ink jet recording apparatus is provided with a recovery unit 7 at a position facing the nozzle surface of the nozzle rows outside the paper passing range in the main scanning direction. The recovery unit 7 vacuums forcibly the ink and the air from the ejecting nozzle surface for cleaning the ejecting nozzle or filling the ink to be described later.

Embodiment 1

Figure 2B:
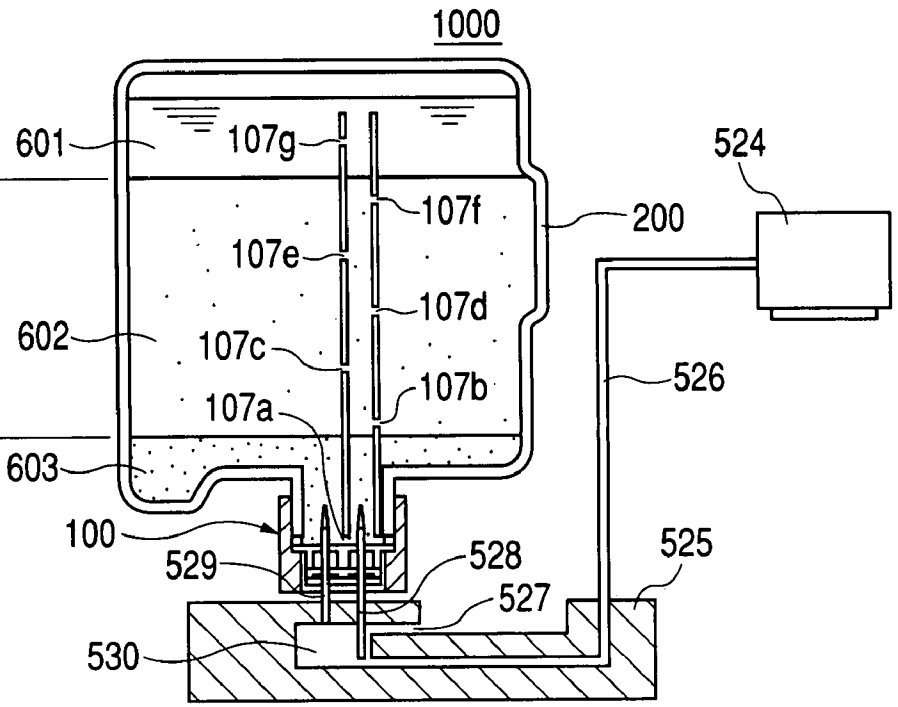
FIG. 2B is a graph showing the relationship between the height from the tank bottom surface and the ink density (pigment density, content density).
Figure 2A:
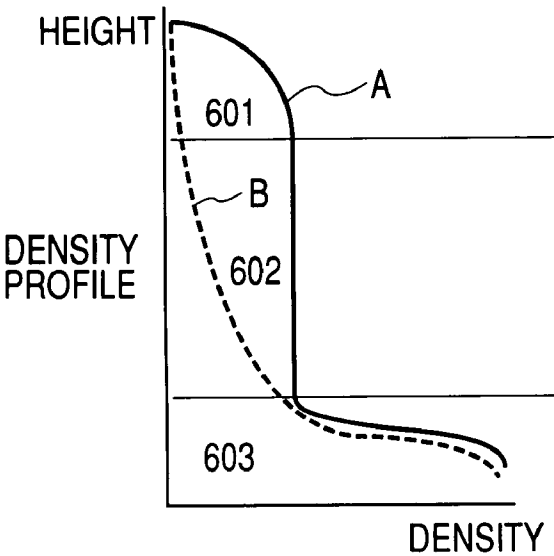
FIG. 2A is a schematic diagram showing the schematic configuration of an ink supply system in the case of using a first embodiment of a liquid storage container adopting the present invention as the ink tank of the ink jet recording apparatus.
Figure 3:
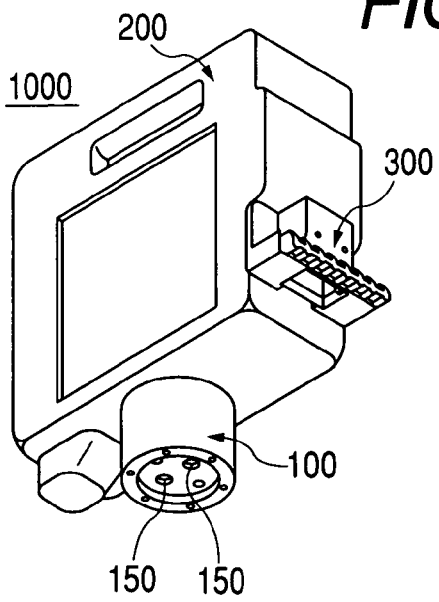
FIG. 3 is a schematic perspective view showing the first embodiment of the liquid storage container adopting the present invention.
Figure 4:
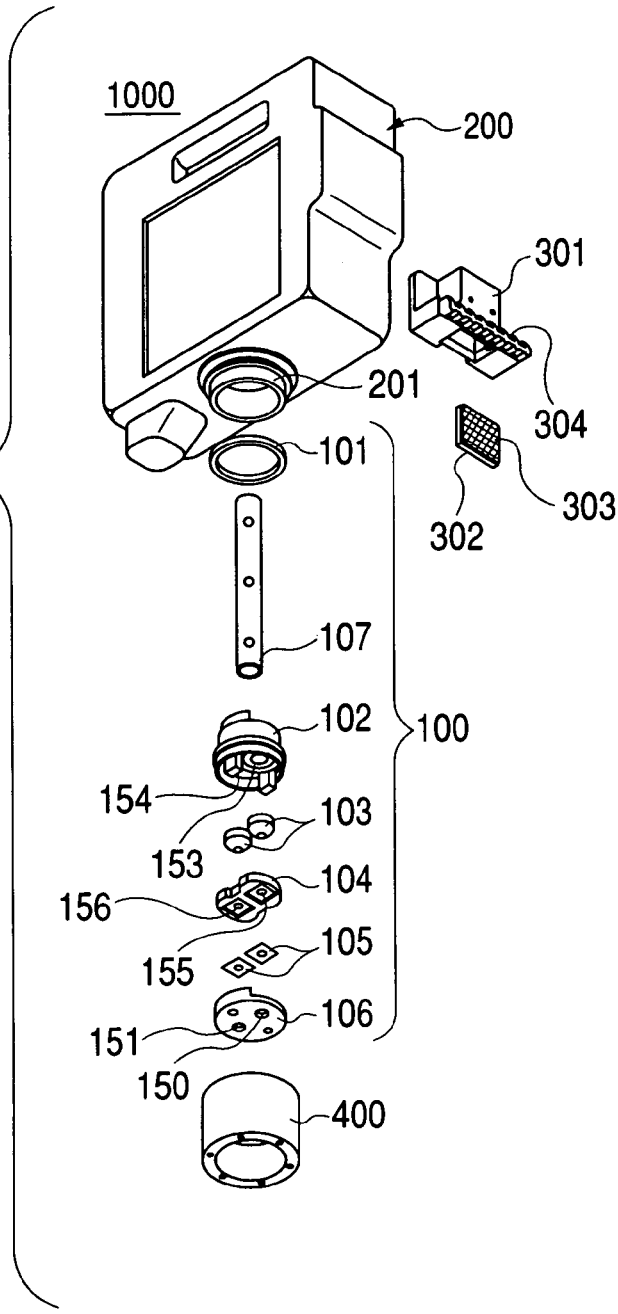
FIG. 4 is a schematic exploded perspective view showing the schematic configuration of the liquid storage container of FIG. 3.

FIG. 2A is a schematic diagram showing the schematic configuration of an ink supply system in the case of using a first embodiment of a liquid storage container adopting the present invention as the ink tank of the ink jet recording apparatus; and FIG. 2B is a graph showing the relationship between the height from the tank bottom surface and the ink density. FIG. 3 is a schematic perspective view showing the first embodiment of the liquid storage container adopting the present invention. FIG. 4 is a schematic exploded perspective view showing the schematic configuration of the liquid storage container of FIG. 3.

Figure 5:
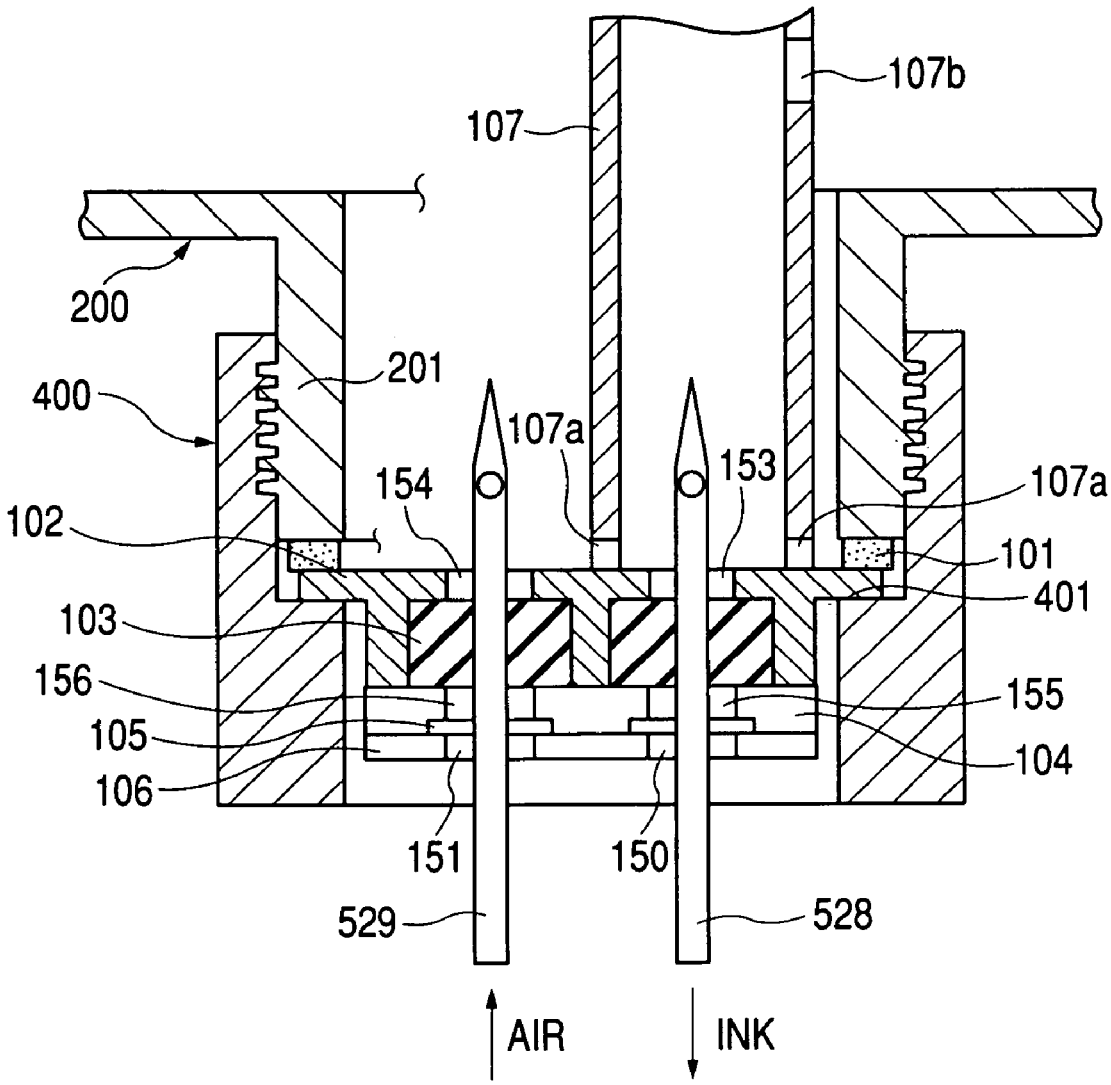
FIG. 5 is an enlarged vertical sectional view showing the detailed structure of the connecting unit of the liquid storage container shown in FIGS. 2A, 2B to 4.
Figure 6B:
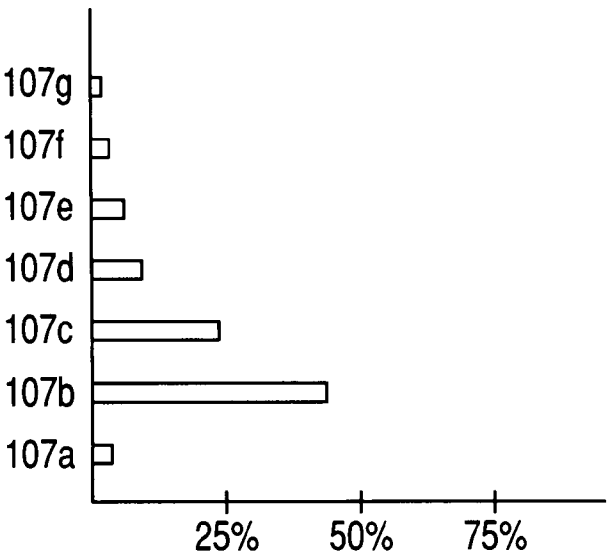
FIG. 6B is a graph showing the ratio of the ink amount passing through each liquid inlet hole of the ink agitating chamber at the time of supplying the ink.
Figure 6A:
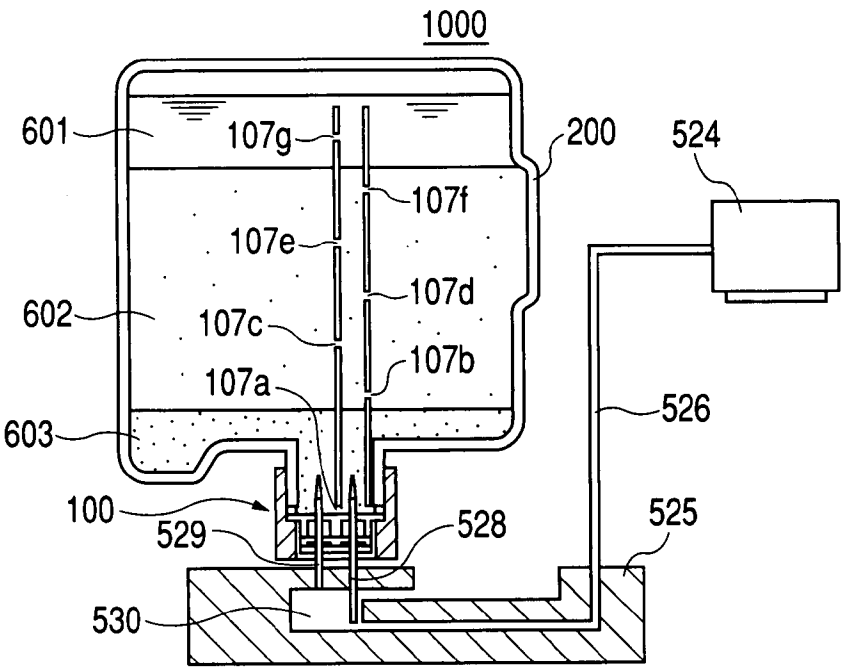
FIG. 6A is a schematic diagram showing the internal state wherein the ink liquid level is sufficiently high in the liquid storage container of FIGS. 2A, 2B.
Figure 7B:
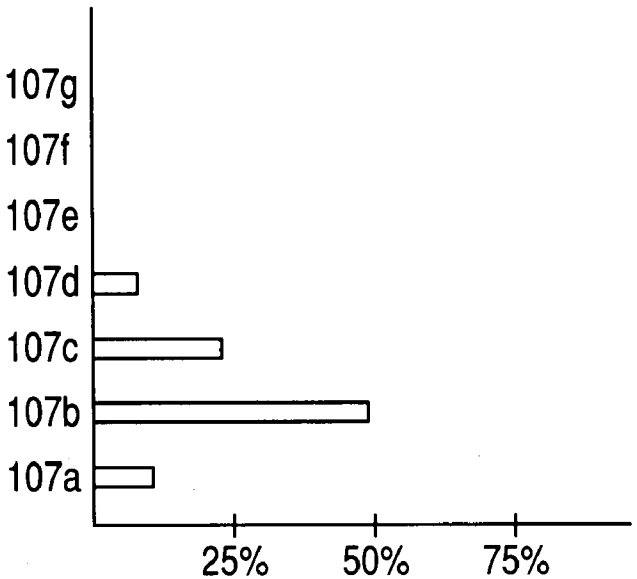
FIG. 7B is a graph showing the ratio of the ink amount passing through each liquid inlet hole of the ink agitating chamber at the time of supplying the ink.
Figure 7A:
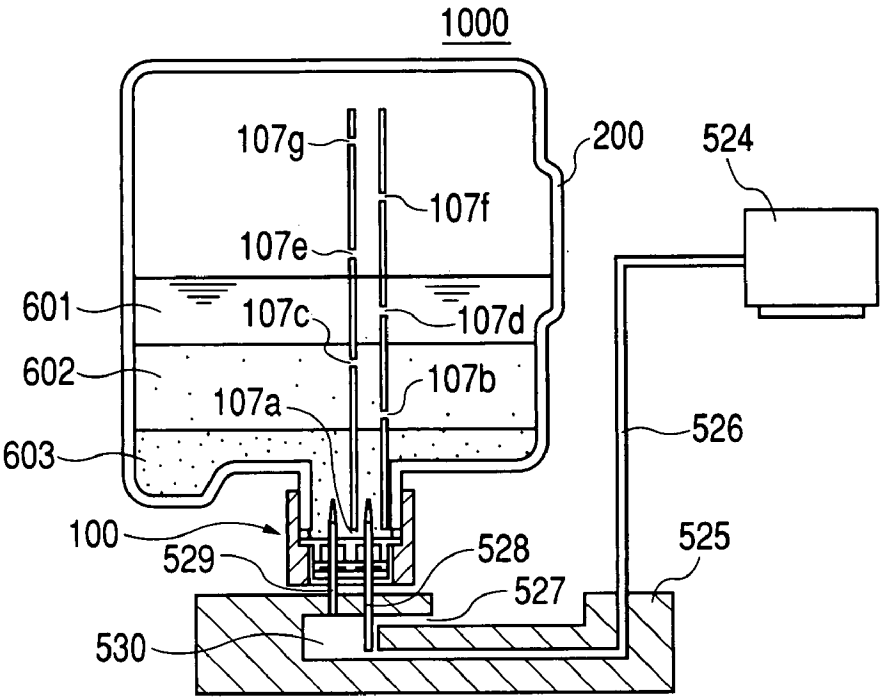
FIG. 7A is a schematic diagram showing the internal state wherein the ink liquid level is lowered to the middle height by the ink consumption from the state of FIGS. 6A, 6B.
Figure 8B:
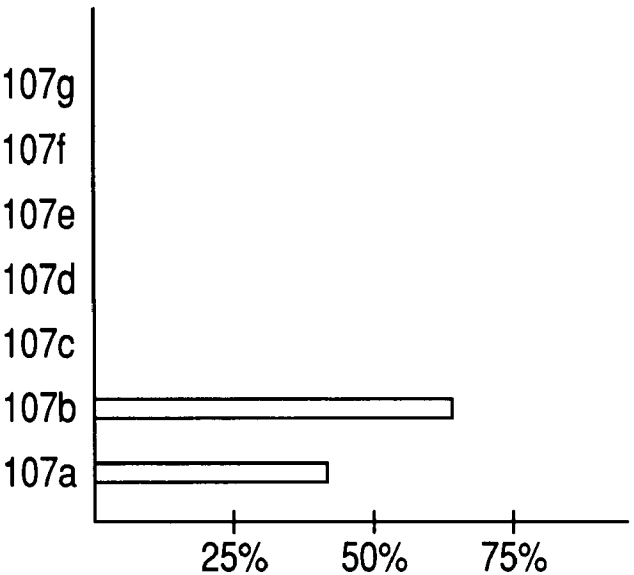
FIG. 8B is a graph showing the ratio of the ink amount passing through each liquid inlet hole of the ink agitating chamber at the time of supplying the ink.
Figure 8A:
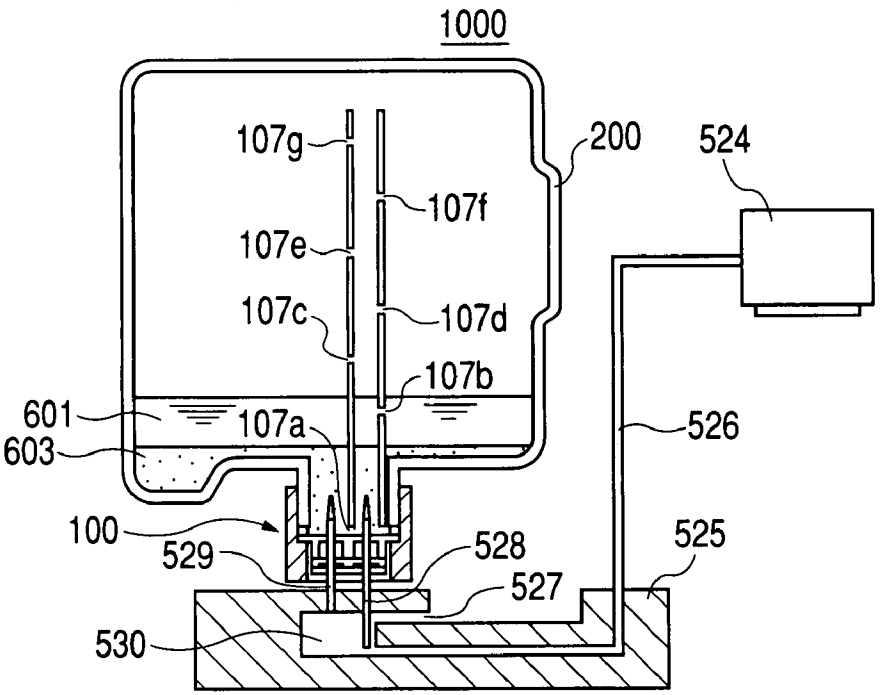
FIG. 8A is a schematic diagram showing the internal state wherein the ink liquid level is lowered to about 20% of the initial stage by further consumption of the ink from the stage of FIGS. 7A, 7B.

FIG. 5 is an enlarged vertical sectional view showing the detailed structure of the connecting unit of the liquid storage container shown in FIGS. 2A, 2B to 4. FIG. 6A is a schematic diagram showing the internal state wherein the liquid level (ink liquid level) is sufficiently high in the liquid storage container of FIGS. 2A, 2B; and FIG. 6B is a graph showing the ratio of the ink amount passing through each of a plurality of liquid inlet holes of the agitating chamber (ink agitating chamber) at the time of supplying the liquid (ink). FIG. 7A is a schematic diagram showing the internal state wherein the liquid level is lowered to about 50% of the initial stage by the ink consumption from the state, of FIGS. 6A, 6B; and FIG. 7B is a graph showing the ratio of the ink amount passing through each liquid inlet hole of the agitating chamber at the time of supplying the ink. FIG. 8A is a schematic diagram showing the internal state wherein the liquid level is lowered to about 20% of the initial stage by further consumption of the ink from the stage of FIGS. 7A, 7B; and FIG. 8B is a graph showing the ratio of the ink amount passing through each liquid inlet hole of the ink agitating chamber at the time of supplying the ink.

In FIGS. 2A, 2B to 8A, 8B, a liquid storage container 1000 adopting the present invention is mounted and used in a posture with connecting openings 150, 151 of a connecting unit 100 oriented downward. Therefore, the connecting unit 100 side having the connecting openings 150, 151 is the bottom part of the liquid storage container 1000. Thus, as shown in FIG. 2A, in the case the liquid storage container 1000 is the ink tank of the ink jet recording apparatus, it is mounted on the mounting part (ink supply unit of FIG. 1) of the ink jet recording apparatus in a stage with the connecting openings 150, 151 oriented downward so as to be used for supplying the ink to the ink jet head (recording head) as the recording means of the ink jet recording apparatus.

As shown in FIG. 3, the liquid storage container 1000 comprises a liquid storage part (ink storage part) 200 for storing a liquid (ink), a connecting unit 100 for taking out the liquid in the container main body 200, an information memory medium unit 300 for taking out various kinds of the information on the liquid storage container 1000, and a cap member 400. The liquid storage part 200 is a hollow container produced by blow molding of a plastic material. The connecting unit 100 has a plurality of connecting parts for inserting through a liquid supplying hollow needle and an atmosphere guiding hollow needle. The connecting unit 100 is pressured and clamped against an opening part 201 formed in the liquid storage part 200 via a sealing member 101 (see FIG. 4) in the airtight state. The cap member 400 is screwed (fastened) into a male screw part in the outer circumference of the opening part 201 for pressuring and clamping the connecting unit 100 against the opening part 201 via the sealing member 101. The information memory medium unit 300 is positioned and fixed on the side surface of the liquid storage part 200 by ultrasonic welding, or the like.

Next, with reference to FIGS. 4 and 5, the connecting unit 100 will be explained in detail. The connecting unit 100 having the plurality of the connecting part comprises integrally a housing 102 having communicating holes 153, 154 formed at a position corresponding to the connecting openings 150, 151 communicating with each connecting part, two elastic members 103 made of a rubber-like elastic material mounted at a position corresponding to the communicating holes 153, 154 in the housing 102, a pressuring member 104 having communicating holes 155, 156 formed at a position corresponding to the connecting openings 150, 151, two absorbing members 105 disposed in the pressuring member 104, an absorbing member cover 106 mounted on the outside of the absorbing members 105, and a cylindrical ink agitating chamber 107 provided with a plurality of holes 107*a*, 107*b*, 107*c*, 107*d*, 107*e*, 107*f*, 107*g* in the cylinder side surface, and a hole 107*h* in the cylinder ceiling.

Accordingly, the liquid storage container 1000 comprising the liquid storage part 200 having the opening 201, and the connecting unit 100 having the connecting part for guiding (taking out) the liquid from the liquid storage part and the connecting part for guiding the air into the liquid storage part, with the elastic members 103 supported at the connecting part in the compressed state, is provided as a combination of the liquid storage part 200 and the connecting unit 100.

The connecting openings 150, 151 are formed in the absorbing member cover 106. Moreover, the pressuring member 104 is clamped on the housing 102 by fixing by ultrasonic welding or by an engaging nail (not shown), or the like.

The elastic members 103 having a dome-like shape, are compressed and fixed by the pressuring member 104. That is, since the elastic members 103 are made of a dome-like shaped rubber-like elastic material, they can be mounted each in the two recess parts of the housing 102 so as to be compressed and fixed by the pressuring member 104 for generating the compression force of the elastic members 103 in the radial direction and mounting in the airtight sealed state.

Moreover, the two absorbing members 105 disposed in the pressuring member 104 are clamped (stopped) by the absorbing member cover 106. The absorbing member cover 106 is fixed on the pressuring member 104 or the housing 102 by ultrasonic welding or by an engaging nail (not shown), or the like. Furthermore, the ink agitating chamber 107 is fixed on the housing 102 by ultrasonic welding, or by an engaging nail (not shown), fitting, or the like. Accordingly, the connecting unit 100 is provided.

As shown in FIG. 5, the connecting unit 100 is fixed on the opening part 201 of the liquid storage part (container main body) 200 in the sealed state by screwing the cap member 400 having an inner screw into the outer circumference screw of the opening part 201 via the sealing member 101.

Then, at the time of using the liquid storage container 100, as shown in FIG. 5, a supply needle 528 and an air guiding needle 529 communicate with the ink agitating chamber 107 and the container main body 200 while piercing through the connecting openings 150 151, the absorbing members 105, 105, the communicating holes 155, 156, the elastic members 103, 103 and the communicating holes 153, 154 so that the ink supply path and the atmosphere guiding path are connected via the connecting unit 100 so as to execute a predetermined function (ink supply, or the like). That is, a plurality of connecting part, communicating with the plurality of the connecting openings 150, 151 is formed in the connecting unit 100. The liquid supply needle 528 is for guiding out the liquid in the liquid storage part 200, and the air guiding needle 529 is for guiding the air into the container main body 200.

In FIG. 5, the top surface of the cap 400 is opened as shown in the figure. Therefore, the connecting openings 150, 151 formed in the outer side end face (absorbing member cover 106) of the connecting unit 100 are exposed even in the state being fixed on the connecting unit 100 by the cap 400. The cap 400 is screwed (fastened) by the screw engagement with the opening part 201 of the liquid storage part (container main body) 200. In the inner diameter part thereof, an engaging part 401 is formed such that the connecting unit 100 can be clamped between the opening part 201 and the cap 400.

The sealing member 101 is compressed by a predetermined amount between a ring-like stepwise part 157 formed in the outer circumference of the housing 102 of the connecting unit 100 and the opening part 201 of the container main body (liquid storage part) 200 by screwing (fastening the cap 400 such that the inside of the ink tank 1000 can be maintained in the airtight state. That is, as shown in FIG. 5, in the housing 102 of the connecting unit 100, the engaging surface (stepwise part) 157 is formed in the top end surface of the opening part of the container main body 200 so that the assembly can be enabled in the certain sealed state by clamping the sealing member (ring-like sealing member) 101 by a predetermined compression force in the ring-like groove formed in the outer circumference of the housing 102.

Next, the information memory medium unit 300 will be explained. In FIG. 4, the information memory medium unit 300 comprises an information memory medium holder 301, an information memory medium 302 positioned and fixed on the inner surface of the recess part of the information memory medium holder 301 by a double side adhesive tape 303, and a comb teeth-like ID part (mechanical identifying part) comprising a plurality of projections 304 projecting from the outer surface of the information memory medium holder 301.

First, the information memory medium 302 will be explained. The information memory medium 302 can exchange the information with the ink jet recording apparatus in a state with the ink tank (liquid storage container) 1000 mounted on an ink jet recording apparatus. The information exchanged between the information memory medium 302 and the ink jet recording apparatus is, for example, information on the ink use period, the ink amount in the ink tank 1000, the ink color, or the like. By taking out the information by the control part of the ink jet recording apparatus, replacement of the ink tank can be advised to the user by outputting the alarm for the use period or the ink exhaustion, or the like. Thereby, a process of preventing generation of the influence of discoloration or thickening of the ink on the recorded image, and a process of preventing generation of the recording failure due to a recording operation in a state with the ink tank holding an ink of a wrong color mounted inadvertently, or the like can be executed. Accordingly, a recording operation can be executed always preferably so that a high grate image output can be obtained.

As the information memory medium 302, any one such as a flash memory, and a write at once magnetic medium can be used as long as it is a medium capable of obtaining the identification information by various kinds of information obtaining means such as magnetic, optical magnetic, electric, and mechanical. According to the ink tank 1000 of this embodiment, as a medium capable of adding the memory information from the recording apparatus main body side, changing or deleting the memory information, in addition to maintaining the ink tank identification information, and writing of the information from the recording apparatus main body side, an EEPROM capable of having an electric writing and erasing process. The EEPROM is mounted on a printed circuit board having a connecting part to be electrically connected with an electric signal connector provided on the recording apparatus main body side, with these elements provided integrally, the information memory medium 302 can be provided.

Next, the above-mentioned comb teeth-like projection 304 is used for the ID for preventing the mounting error of the ink tank. The ink tanks are cut for a predetermined part for each ink color, for the kind of the recording apparatus, or the like. The projections are provided at a position on the main body side, corresponding to the cut part of the ink tank so that only the correct ink tank (kind, color, or the like) can be mounted. In addition to the above-mentioned mounting error prevention by the information memory medium, the mounting error can be prevented by the mechanical configuration.

Next, an example of the ink supply system (recording liquid supply system) of the ink jet recording apparatus with the liquid storage container (ink tank) 1000 of this embodiment connected will be explained with reference to FIG. 2A. FIG. 2A is a schematic diagram showing the entire schematic configuration of the recording liquid supply system for recording by connecting the liquid storage container 1000 with the ink jet head (recording head) 524 as the recording means via the connecting unit 100, and jumping the ink from the ink jet head onto the recording medium.

The recording head (ink jet head) 524 as the recording means is ink jet recording means for ejecting the ink, utilizing the thermal energy, and it comprises an electro thermal converting member for generating the thermal energy. Moreover, the recording means (recording head) 524 is for recording by generating the film boiling in the ink by the thermal energy applied by the electro thermal converting member, and ejecting the ink from the ejecting opening, utilizing the pressure change by the growth and contraction of the bubbles generated at the time.

In FIG. 2A, the recording head (ink jet head) 524 is connected fluidally with the ink tank 1000 via the ink supply pipe 526. The top end on the ink tank 1000 side of the ink supply pipe 526 is connected with the buffer chamber 530 of the ink supply unit 525. The ink supply unit 525 is provided with the hollow ink supply needle (ink guiding out needle) 528 communicating with the buffer chamber 530 and the air guiding needle 529. The ink supply needle 528 for guiding out the liquid (ink) from the liquid storage part (ink storage part) 200 elongates (extends) in the ink storage part (container main body) 200 while piercing through the elastic member 103 disposed corresponding to the first fluid connecting part 150 of the ink tank 1000 such that the ink in the liquid storage part (container main body) 200 can be taken out and supplied (guided out) through the needle hole opened in the vicinity of the top end. At the time, since the elastic member 103 is compressed and fixed as mentioned above, by pressuring the outer circumference of the pierced through ink supply needle 528, the airtight property in the periphery of the ink supply needle 528 can be maintained so that the ink leakage can be prevented.

Moreover, the ink supply unit 525 is provided with the air guiding needle 529 communicating with the buffer chamber 530. Like the above-mentioned ink supply needle 528, the air guiding needle 529 elongates into the ink storage part 200, piercing through the elastic member 103 disposed corresponding to the second fluid connecting opening 151 of the ink tank 1000 for guiding the air (atmospheric pressure) into the ink storage part 200 through the needle hole opened in the vicinity of the top end. At the time, since the elastic member 103 is compressed and fixed as mentioned above, the airtight property in the periphery of the air guiding needle 529 is maintained by pressuring the outer circumference of the pierced through air guiding needle 529.

The buffer chamber 530 is provided with the buffer chamber air communicating part 527 communicating with the outside of the ink supply unit 525 from the upper part thereof. The air guiding needle 529 elongates to the middle in the height direction of the buffer chamber 530, and the ink guiding out needle (ink supply needle) 528 elongates to the downward of the air guiding needle 529. In the ordinary state, the inside of the buffer chamber 530 is filled with the ink to the lower end position of the air guiding needle 529 in a state with the buffer space generated in the upper part.

Next, with reference to FIG. 2A showing the ink supply system of the ink jet recording apparatus, the liquid storage container 1000 according to the first embodiment explained with reference to FIGS. 3 to 5 will be explained for the ink guiding out operation (ink supply operation) at the time of taking out the ink for the use as the ink tank. The ink guiding out operation and the detailed explanation for the parts directly related with the characteristic configuration of the present invention will be described later.

In FIG. 2A, the ink jet head 524 executed a recording operation by ejecting the ink from the ejecting opening 82 formed in the ink ejecting opening surface 81 on a recording medium (paper, or the like). Then, the ink is supplied form the ink tank 1000 to the ink jet head 524 via the ink supply pipe 526 for complementing the ejected ink.

The ink supply pipe (it may be in the halfway thereof) connecting the connecting unit 100 and the recording head 524 is provided with the ink supply unit 525. In the case the ink in the ink storage part 200 is reduced according to the ink supply, the pressure in the ink storage part 200 is lowered. Then, the air to be guided from the buffer chamber air communicating part 527 provided in the ink supply unit 525 to the buffer chamber 530 is guided into the ink storage chamber through the air guiding needle 529.

Here, according to the ink jet recording apparatus, the ink to be supplied to the ink jet head 524 should be maintained in a predetermined negative pressure state. In the case of the ink supply system of this embodiment, the lower end opening of the air guiding needle 529 for guiding the air into the tank main body (container main body) 200 is disposed at a position lower than the ejecting opening surface 81 of the ink jet head 524 such that the height difference (head difference h) of the lower end opening of the air guiding needle 529 and the ejecting opening surface 81 functions to the ejecting opening 82 of the ink jet head 524 always as a negative pressure. That is, regardless of the liquid level height of the ink in the ink tank 1000, a substantially constant negative pressure is always applied to the ejecting opening 82 of the ink jet head 524.

Next, with reference to FIG. 2A, the case with the air in the liquid storage part 200 expanded or contracted by the environment change such as the temperature and the pressure will be explained. At the time the air in the liquid storage part 200 is expanded, the liquid (ink) is pushed out into the buffer chamber 530 via the air guiding pipe (needle). The buffer chamber 530 has a sufficient content so as not to overflow the ink from the buffer chamber even in the case the imaginable environment change is generated. Moreover, even in the case a light amount of the ink is overflowed, the ink is absorbed by the waste ink absorbing member (not shown) provided at the top of the buffer chamber air communicating part 527 so that the other parts in the recording apparatus cannot be polluted with the ink. In contrast, in the case the air in the liquid storage part 200 is contracted, the air (outside air) is guided into the ink tank via the hollow air guiding needle 529 and the agitating chamber 107.

Although the configuration of guiding the air from the air guiding needle 529 is shown in this embodiment as the configuration of compensating the pressure decline in the ink storage part 200 accompanied by the ink supply to the ink jet head 524, it is also possible that the second connecting opening (air guiding connecting opening) 151 of the connecting unit 100 is connected with a system for supplying a liquid in a constant pressure condition for supplying the ink (liquid) for compensating the pressure decline. The liquid (ink) in this case may be the same kind of the liquid as the liquid (ink) stored in the ink storage part (container main body) 200.

Then, the liquid storage container 1000 according to the embodiment adopting the present invention, comprises the liquid storage part 200 for storing the liquid such as the ink, the liquid taking out connecting part (connecting part communicating with the connecting opening 150) provided in the bottom part of the liquid storage part, and the agitating chamber 107 provided in the liquid storage part so as to cover the opening on the liquid storage part side of the connecting part, wherein a plurality of the liquid inlet holes 107*a* to 107*g* each communicating with the liquid storage part at a plurality of positions in the vertical direction are formed in the agitating chamber such that the inlet resistance of the liquid inlet hole 107*a* provided in the lower layer area on the bottom part side, with the content density made thicker than the initial density in the case the liquid content in the liquid storage part is precipitated according to the time passage is made larger than the inlet resistance of the other liquid inlet holes 107*b* to 107*g* out of the plurality of the liquid inlet holes of the agitating chamber.

Hereinafter, with reference to FIGS. 1, 5, 8A and 8B, the configuration characteristic of the liquid storage container 100 according to the embodiment adopting the present invention, and the effect at the time of precipitating the pigment (pigment particle) as the liquid content will be explained.

In the case the ink tank 1000 as the liquid storage container is left for a long time in a state mounted on the ink jet recording apparatus, the pigment particles as the liquid content are precipitated inside the ink tank 1000. FIG. 2B shows the pigment particle density profile gradually changed according to the vertical direction distance from the bottom surface of the liquid storage part 200. In the ink with the precipitation generated, as the curve B in FIG. 2B, there is an ink with the pigment particle density changed gradually according to the vertical direction distance from the bottom surface. According to this embodiment, the considerable effect can be expected in the profile of the curve B.

However, depending on the distribution of the particle size and the particle size distribution of the precipitated particles in the ink, and the ink component, as shown by the curve A in FIG. 2B, there is an ink having the density inclination of the pigment particles generated from the bottom part to the upper part direction inside the ink tank so as to be separated into a lower layer 603 with the high pigment particle density in the bottom part (hereinafter, it may also be referred to as the pigment high density layer 603), an upper layer 601 with the low pigment particle density in the upper part (hereinafter, it may also be referred to as the pigment low density layer 601), and a middle layer 602 maintaining substantially the initial pigment particle density (hereinafter, it may also be referred to as the pigment middle density layer 602). In this embodiment, the maximum effect can be performed for the ink of the curve A of FIG. 2B. Therefore, in the description below, the ink having the profile shown by the curve A in FIG. 2B after the precipitation will mainly be explained.

FIGS. 2A and 6A shows the relationship between the height of the pigment precipitation layers 601, 602, 603, and the height to each of the plurality of the liquid inlet holes 107*a*, 107*b*, 107*c*, 107*d*, 107*e*, 107*f*, 107*g* provided in the ink agitating chamber 107 at the time the ink amount in the ink tank 1000 is substantially full. Then, the pigment high density layer 603 is provided with the liquid inlet hole 107*a* out of the plurality of the liquid inlet holes 107*a* to 107*g*. Moreover, the pigment middle density layer 602 is provided with the liquid inlet holes 107*b*, 107*c*, 107*d*, 107*e*, 107*f*, and the pigment low density layer 601 is provided with the liquid inlet hole 107*g*.

FIG. 6B shows the ink amount ratio passing through each of the plurality of the holes 107*a* to 107*g* of the ink agitating chamber 107 at the time of supplying the ink to the ink jet head 524 in the state of FIG. 6A. Then, as shown in FIG. 6A, the ink is supplied to the out side (to the ink jet head 524, or the like) through the ink supply pipe 526 by printing or vacuuming with a pump in a state with the pigment precipitation, and at the same time, the ink from each of the pigment high density layer 603, the pigment low density layer 601, and the pigment middle density layer 602 (not from a specific layer) is guided into the agitating chamber 107 through the liquid inlet holes 107*a* to 107*g* so as to generate temporary stagnation and mixture in the agitating chamber 107.

Here, according to this embodiment, for restraining the inlet amount of the liquid (ink) by enlarging the inlet resistance (flow resistance) value only for the liquid inlet hole 107*a* disposed in the lower layer area having the pigment density (content density) thicker than the initial thickness, the hole size of the liquid inlet hole 107*a* is made smaller than the hole size of the other liquid inlet holes 107*b* to 107*g*. For example, the liquid inlet hole 107*a* is formed as a semi circle hole of R=0.75 mm, and the liquid inlet holes 107*b* to 107*g* are formed as a round hole of a 2 mm diameter. Here, FIGS. 6*a*, 6B show the inlet ink amount frown from each of the holes 107*a* to 107*g* into the ink agitating chamber 107 at the time the ink is supplied to the printer main body.

Since the inlet amount is as shown in FIG. 6B, and the ink is vacuumed from the ink supply needle 528, the inlet amount from the hole away from the ink supply needle 528 becomes small. Moreover, since the flow resistance (inlet resistance) of the hole 107*a* closest to the ink supply needle 528 is made larger as mentioned above, the inlet amount from this hole 107*a* is small. Therefore, at the item of supplying the ink, the ink of the most of the total inlet amount (90% in this embodiment) to the ink agitating chamber 107 is supplied form the pigment middle density layer 602, and the inlet amounts from the pigment high density layer 603 and the pigment low density layer 601 are substantially equal, the ink of the initial pigment particle density can be supplied.

FIGS. 7A, 7B shows the state with the liquid level lowered to the middle position according to the ink consumption from the state of FIGS. 6A, 6B. FIG., 7A shows the relationship between the height of the pigment precipitation layers 601, 602, 603 in the ink tank and the height of each of the plurality of the holes 107*a* to 107*g* provided in the ink agitating chamber 107. The pigment high density layer 603 is provided with only the hole 107*a* out of the plurality of the holes 107*a* to 107*g*. Moreover, the holes 107*b* to 107*c* are disposed at the pigment middle density layer 602, and only the hole 107*d* is disposed at the pigment low density layer 601.

FIG. 7B shows the ink amount ratio passing through each of the holes 107*a* to 107*g* at the time the ink is supplied to the ink jet head 524 in the state of FIG. 7A. In this case, since the liquid level is lower than the hole 107*e*, the ink is not supplied form the holes 107*e* to 107*g*.

Accordingly, in the case the ink is consumed and the liquid level becomes lower than the hole 107*g*, the inlet amounts from the pigment high density layer 603 and the pigment low density layer 601 are increased compared with the state of FIGS. 6A and 6B. However, since most of the inlet ink (70% to 80% in this embodiment) is provided still from the pigment middle density layer 602, and the inlet amount balance from the pigment high density layer 603 and the pigment low density layer 601 is unchanged, the ink of the initial pigment particle density can be supplied.

FIGS. 8A and 8B show the state with the further ink consumption from the state of FIGS. 7A and 7B so as to have the liquid level lowered to 20% of the initial stage. FIG. 8A shows the relationship between the height of the pigment precipitation layers in the ink tank and the height to each of the plurality of the holes 107*a* to 107*g* provided in the ink agitating chamber 107. Since the hole 107*a* is disposed at the pigment high density layer 603 out of the plurality of the holes 107*a* to 107*g*, and the pigment middle density layer 602 is substantially used up so that the hole does not exist, and the hole 107*b* is disposed at the pigment low density layer 601.

FIG. 8B shows the ink amount ratio passing through each hole 107*a* to 107*g* at the time the ink is supplied in the state of FIG. 8A. In this case, since the liquid level is lower than the hole 107*c*, the ink is not supplied from the higher holes 107*d* to 107*g*. As shown in FIGS. 8A, 8B, in the case the liquid level is at a height of about 20% or less of the ink tank container, the ink of the pigment middle density layer 201 is substantially used up according to the process explained with reference to FIGS. 6A, 6B, 7A, 7B so that the initial pigment density ink can be supplied by agitating the remaining pigment high density layer 603 and pigment low density layer 601 in the ink agitating chamber 107.

According to the embodiment explained above, while paying the attention to the separation of the pigment (liquid content) into the three precipitation layers 601, 602, 603, by agitating and mixing the thin pigment density layer 601 and the thick layer 603 finally after first using up the ink maintaining the conventional pigment density (pigment middle density layer 602), the liquid storage container 1000 capable of preventing the density difference generation of the degree visibly observable in the recorded matter even at the time of use over a long period, and capable of supplying the ink of the initial density to the printer main body, that is, the liquid storage container 1000 using a pigment as the coloring agent, capable of preventing the density variance while recording can be provided.

Embodiment 2

Figure 9:
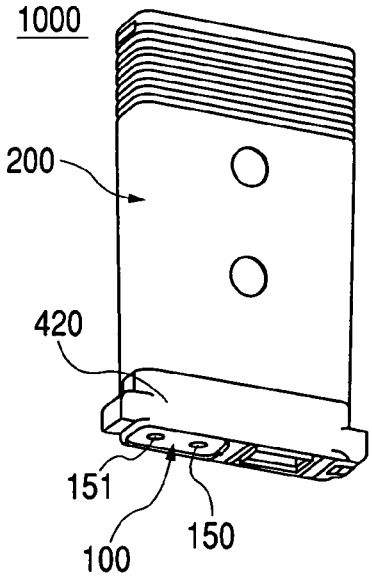
FIG. 9 is a schematic perspective view showing a second embodiment of the liquid storage container adopting the present invention.
Figure 10:
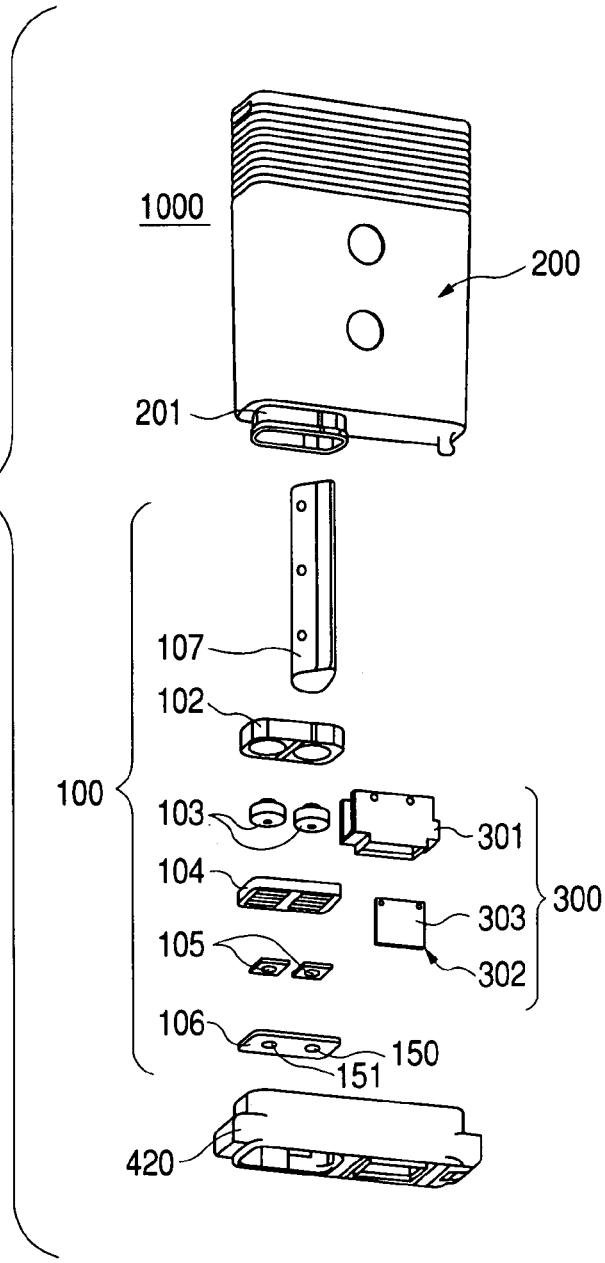
FIG. 10 is a schematic exploded perspective view showing the schematic configuration of the liquid storage container of FIG. 9.

FIG. 9 is a schematic perspective view showing a second embodiment of the liquid storage container adopting the present invention. FIG. 10 is a schematic exploded perspective view showing the schematic configuration of the liquid storage container of FIG. 9. With reference to FIGS. 9 and 10, another embodiment (second embodiment) of the liquid storage container adopting the present invention will be explained.

In FIGS. 9, 10, the second embodiment of the liquid storage container 1000 adopting the present invention is also to be used while being mounted in a posture with the connecting openings 150, 151 of the connecting unit 100 disposed downward. Therefore, the connecting unit 100 side having the connecting openings 150, 151 is the bottom part of the liquid storage container 1000. That is, in the case the liquid storage container 1000 is the ink tank of the ink jet recording apparatus, it is mounted detachably on the mounting part of the ink jet recording apparatus with the connecting openings 150, 151 disposed downward so as to be used for supplying the ink to the ink jet head as the recording means of the ink jet recording apparatus.

In FIGS. 9, 10, the liquid storage container 1000 comprises the liquid storage part (ink storage part) 200 for storing the liquid (ink), the connecting unit 100 for taking out the liquid in the liquid storage part 200, the information memory medium unit 300 for taking out various kinds of the information concerning the liquid storage container 1000, and a guard member 420. In this embodiment, the liquid storage container 200 comprises a flat hollow container produced by blow molding of a plastic material. This is for saving the space (miniaturization) of the appliance in the case of mounting a plurality of the liquid storage containers (ink tank) in the appliance such as a recording apparatus.

The connecting unit 100 having the plurality of the connecting part comprises integrally a housing 102 having communicating holes formed at a position corresponding to the connecting openings 150, 151 communicating with each connecting part, two elastic members 103 made of a rubber-like elastic material mounted at a position corresponding to the communicating holes in the housing 102, a pressuring member 104 having communicating holes formed at a position corresponding to the elastic members 103, two absorbing members 105 disposed in the pressuring member 104, an absorbing member cover 106 mounted on the outside of the absorbing members 105. Also in this embodiment, the connecting openings 150, 151 are formed in the absorbing member cover 106. Furthermore, in this embodiment, an ink agitating chamber 107 disposed inside the liquid storage part 200 is provided so as to cover the opening part on the liquid storage part 200 inner side of the connecting unit 100.

As in the case of the above-mentioned first embodiment, the above-mentioned cylindrical ink agitating chamber 107 comprises a plurality of holes 107*a*, 107*b*, 107*c*, 107*d*, 107*e*, 107*f*, 107*g* in the cylinder side surface, and a hole 107*h* in the cylinder ceiling.

Accordingly, in this embodiment, substantially similarly in the case of the liquid storage container 1000 according to the first embodiment explained with reference to FIGS. 2A, 2B to 8A, 8B, the liquid storage container 1000 comprising the liquid storage part 200 having the opening 201, the connecting unit 100 having the connecting part for guiding the liquid from the liquid storage part 200 and the connecting part for guiding the air into the liquid storage part 200, and the ink agitating chamber 107 covering the opening part on the liquid storage part 200 inner side of the connecting unit 100, is provided as a combination thereof.

Furthermore, according to the second embodiment, the pressuring member 104 and the ink agitating chamber 107 are clamped on the housing 102 by fixing by ultrasonic welding, or by an engaging nail, or the like. The elastic members 103 having a dome-like shape, are compressed and fixed in the housing 102 by the pressuring member 104. Moreover, the two absorbing members 105 disposed in the pressuring member 104 are clamped (stopped) by the absorbing member cover 106. The absorbing member cover 106 is fixed on the pressuring member 104 or the housing 102 by ultrasonic welding or by an engaging nail, or the like. Accordingly, the integrated connecting unit 100 is provided. The connecting unit 100 is fixed on the liquid storage part 200 by ultrasonic welding of the housing 102 onto the bonding surface of the opening part 201.

Furthermore, the liquid storage container 1000 of the second embodiment is provided in a hooking stopping structure of hooking the guard member 420 by engaging a projecting hook part elastically deformable with respect to the bottom surface of the liquid storage part 200 and an engaging hole to be engaged with the hook part after fixing the connecting unit 100 (including the ink agitating chamber 107) onto the liquid storage part 200 so that the connecting unit 100 can be protected by the guard member 420.

The guard member 420 is provided for the purpose of protecting the welded connecting unit 100, and protecting and supporting the information memory medium unit 300. Moreover, a mechanical ID comprising comb teeth-like projections is provided for preventing the mounting error of the liquid storage container 1000 at the longitudinal direction end part of the guard member 420 for the same purpose as in the above-mentioned first embodiment.

The liquid storage container 1000 according to the second embodiment has the substantially same configuration as in the case of the first embodiment explained with reference to FIGS. 2A, 2B to 8A, 8B in the other aspects. That is, the second embodiment differs from the above-mentioned first embodiment mainly in the following points.

First, the liquid storage part 200 comprises the flat container shown in the figure so that the space of the appliance can be saved (miniaturization) in the case of mounting a plurality of the liquid storage containers (ink tanks) on an appliance such as a recording apparatus.

Second, since the integrated connecting unit 100 is fixed on the liquid storage part 200 by ultrasonic welding, or the like the members corresponding to the sealing member 10 land the cap member 400 in the above-mentioned first embodiment can be omitted so that further simplification of the structure and reduction of the number of the parts can be achieved.

Third, in the second embodiment, the guard member 420 is provided in a hooking stopping structure of the projecting hook part elastically deformable with respect to the bottom surface of the liquid storage part 200 and the engaging hole to be engaged with the hook part so that the connecting unit 100 and the information memory medium unit 300 can be protected and supported by the guard member 420, and the mechanical ID comprising the comb teeth-like protections for preventing the mounting error of the liquid storage container 1000 is formed.

Therefore, according to the second embodiment, the same effects as in the case of the first embodiment can be achieved.

Although an example of the case of having the two connecting parts in the connecting unit 100 has been explained in the above-mentioned embodiment, the present invention can be adopted similarly in the case of providing three or more connecting parts in the connecting unit so as to obtain the same effects, and this is also included in the scope of the present invention.

Moreover, it is adopted similarly in the one connecting opening for alternately supplying the ink and introducing the atmosphere so as to obtain the same effects, and this is also included in the scope of the present invention.

Moreover, although an example of the case of having a round horizontal cross sectional shape of the ink agitating chamber 107 has been explained in the above-mentioned embodiment, as the cross sectional shape of the connecting unit, an optional shape such as a longer circle, a triangle, and another polygon can be adopted as needed.

Embodiment 3

Figure 11:
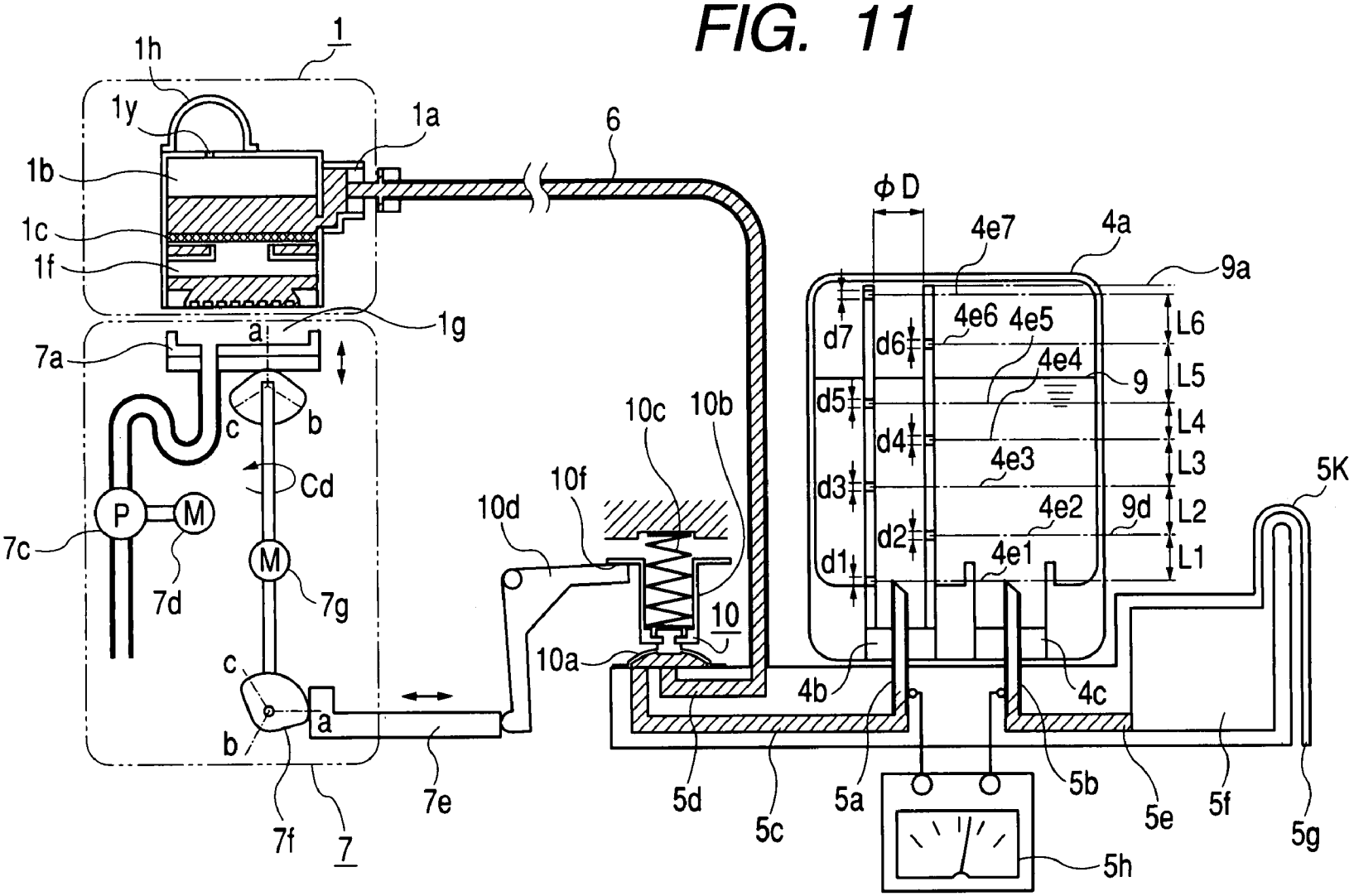
FIG. 11 is a vertical sectional view showing an ink supply system in a third embodiment of the ink jet recording apparatus according to the present invention.
Figure 12:
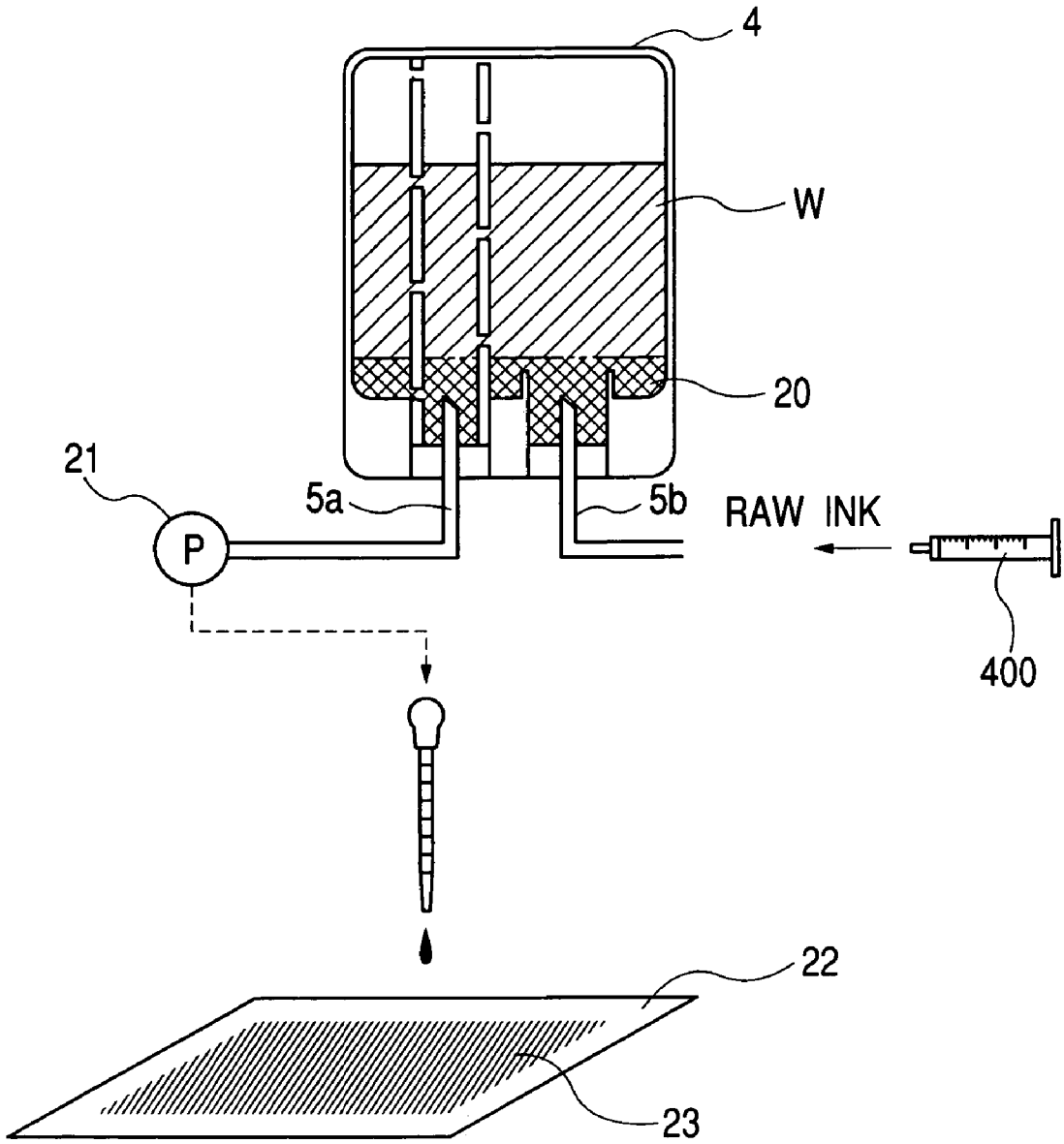
FIG. 12 is a cross sectional view showing an experiment apparatus for confirming the effect of the present invention.
Figure 13:
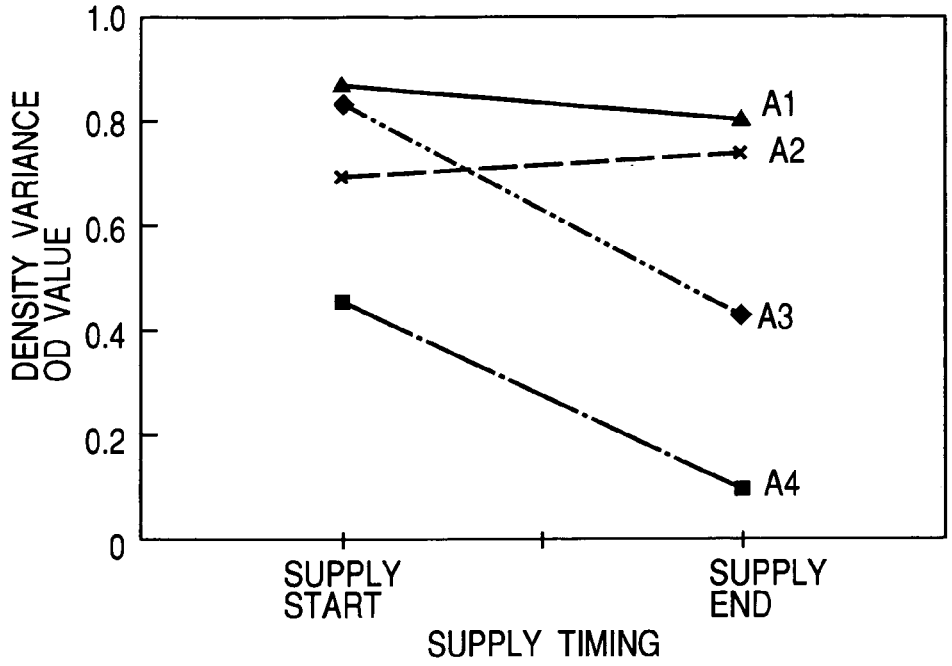
FIG. 13 is a graph showing the density variance of the ink.

FIG. 11 is a vertical sectional view showing an ink supply system in a third embodiment of the ink jet recording apparatus according to the present invention. FIG. 12 is a cross sectional view showing an experiment apparatus for confirming the effect of the present invention. FIG. 13 is a graph showing the density variance of the ink.

First, the ink to be used in this embodiment will be explained.

As the ink suitable for this embodiment, a water based ink comprising water insoluble or hardly soluble coloring material dispersed in a water based medium, can be presented. The coloring material is a substance having the nature of providing the color to an object, and a dispersion dye, a metal complex salt dye, a pigment, or the like can be used.

As the compound for dispersing the coloring material in the water based medium, a dispersing agent, a surfactant, a resin dispersing agent, or the like can be presented. As the dispersing agent and the surfactant, an anion based one, a nonion based one, or the like can be presented. As the resin dispersing agent, a styrene and a derivative thereof, a vinyl naphthalene and a derivative thereof, an acrylic acid and a derivative thereof, or the like can be presented. It is preferable that these resin dispersing agents are an alkaline soluble resin soluble in an aqueous solution with a base dissolved.

As the pigment, in addition to the inorganic pigments such as the ultra marine, the titanium oxide, and the thenard's blue, the organic pigments such as the diazo yellow, the disazo orange, the permanent carmine FB, the phthalocyanine blue, the phthalocyanine green, and the thioindigo violet can be presented, but it is not limited to these pigments.

Next, with reference to FIG. 11, the liquid discharge recording apparatus and the liquid storage container according to this embodiment will be explained.

In FIG. 11, a recording head 1 comprises a liquid connector inserting opening 1*a* to be connected airtight with an ink supply tube 6, and a sub tank 1*b* for accumulating a certain amount of the ink such that the ink supplied from the liquid connector inserting opening 1*a* is maintained in the sub tank 1*b*. The ink in the sub tank 1*b* is supplied to an ejecting nozzle 1*g* while successively passing through a filter 1*c* and a liquid chamber 1*f*.

A pressure adjusting chamber 1*h* is provided on the upper surface of the sub tank 1*b* such that the sub tank 1*b* and the pressure adjusting chamber 1*h* communicates with each other by an upper surface opening hole 1*y*. Moreover, the channel elongating (extending) from the liquid connector inserting opening 1*a* to the ejecting nozzle 1*g* is maintained in a state airtight with respect to the atmosphere.

The ejecting nozzle 1*g* is a minute cylindrical member having about a 20 μm nozzle size. A heater (not shown) to generate the heat selectively according to a command of a CPU is provided inside the cylinder. In the case heat is generated by the heater, the dissolved air in the ink in contact with the heater is expanded and generates bubbles so as to push out the ink in the ejecting nozzle 1*g* so as to eject the ink. After the ejection, the inside of the ejecting nozzle 1*g* is filled with the ink by the capillary tube force of the ejecting nozzle 1*g*. In general, a cycle of the ink ejection is repeated at a high speed of 20 KHz or more so as to form a minute image at a high speed.

Although the inside of the ejecting nozzle 1*g* is maintained at a negative pressure, in the case the negative pressure is weakened to about the atmospheric pressure, if a pollution or ink droplets are adhered on the top end of the ejecting nozzle 1*g*, the ink meniscus in the ejecting nozzle 1*g* is deteriorated so that the ink can be leaked out.

In contrast, in the case the negative pressure is too strong, the force of drawing back the ink into the ejecting nozzle 1*g* becomes stronger than the ejecting force so as to cause the ejection failure. Therefore, the negative pressure in the ejecting nozzle 1*g* needs to be maintained in a constant range slightly lower than the atmospheric pressure. Although the negative pressure range differs depending on the ejecting nozzle type, that is, the ejecting nozzle shape, the heater performance, or the like, in this embodiment, it is provided in a range of −40 mmAq (about 0.004 atm) to −200 mmAq (about 0.020 atm) according to the experiment result. In the experiment, the ink specific gravity was provided substantially equal to the water specific gravity.

The filter 1*c* is provided for the purpose of eliminating the foreign substances, which may choke the ejecting nozzle 1*g*, and it scavenges the foreign substances by a metal mesh of 10 μm or less smaller than the nozzle size of the ejecting nozzle 1*g*.

The filter 1*c* area is set sufficiently large so that the ink pressure loss can be at a tolerance value or less. The pressure loss becomes higher with a smaller mesh size of the filter 1*c*, and a higher ink flow rate, and in contrast, it is counter proportional to the filter area. The high speed, the larger number of nozzles and the minute dots in the recent ink jet recording apparatus lead to the tendency of increasing the pressure loss so that the filter 1*c* size becomes large to about 10×20 mm, and thus the space for the sub tank 1*b* and the liquid chamber 1*f* is needed on the upstream side and the downstream side of the filter 1*c*. As to the ink permeation, since the area of the filter 1*c* soaked with the ink on the upstream side of the filter 1*c* becomes the filter effective area, in order to obtain a sufficiently larger effective area, the filter 1*c* is disposed horizontally on the bottom part of the sub tank 1*b*.

In the case the filter 1*c* is permeated with the ink, minute meniscuses are provided in the mesh so that the ink can be transmitted while inhibiting the air flow. With a smaller mesh, the meniscus strength becomes higher so that the air can hardly pass through. According to the filter 1*c* of this embodiment, the air cannot transmit through the meniscus unless the pressure difference of before and after becomes to about 0.1 atm (experiment value). Thereby, in the case the air is present in the liquid chamber 1*f* on the downstream side of the filter 1*c*, the air cannot move up to the sub tank 1*b* by the pressure of about the floating force of the air itself so as to remain in the liquid chamber 1*f*. Therefore, the upstream side direction entrance of the air can be prevented.

In the case the air or the bubbles in the ink enter into the ejecting nozzle 1*g*, the ink cannot be charged to the ejecting nozzle 1*g* so as to generate the ejection failure. Therefore, the ejecting nozzle 1*g* is disposed downwardly in the bottom part of the liquid chamber 1*f* for accumulating the ink by a certain amount or more so that the upper surface of the ejecting nozzle 1*g* can always be soaked in the ink without being exposed to the air.

The pressure adjusting chamber 1*h* is a room for reducing its capacity as the negative pressure is heightened, comprising an elastic member of a rubber material, or the like. In the case a large amount of the ink per unit time is ejected (hereinafter, it is referred to as the high duty), such as the ink ejection from the all ejecting nozzles 1*g*, at the time of passing through the ink supply unit 5 and the ink supply tube 6 from the main tank 4, the pressure loss is generated in the ink so that the pressure in the sub tank 1*b* is lowered. Thereby, the ink supply amount becomes insufficient with respect to the ink ejection necessary amount so that the negative pressure in the sub tank 1*b* is raised, and the ejection becomes instable in the case the negative pressure of the ejecting nozzle 1*g* exceeds the limit value −200 mmAq (about −0.020 atm).

According to the printer for reciprocal printing in the main scanning direction B with the recording head 1 mounted on the carriage 2, since the carriage 2 is inverted after the high duty printing, an ejection pause state exists. The pressure adjusting chamber 1*h* plays a roll of a capacitor of alleviating the negative pressure rise in the sub tank 1*b* by the capacity reduction, and recovers the negative pressure to the normal value at the time of the inversion.

Next, the ink supply unit 5 and the main tank 4 will be explained.

The main tank 4 comprising a rigid case 4*a* provided with two rubber plugs 4*b*, 4*c* in the lower part, is detachable with respect to the ink supply unit 5. The main tank 4 is a sealed container as a single body for storing the ink 9 as a liquid.

The ink supply unit 5 is provided with a supply needle 5*a*, and an atmosphere guiding needle 5*b*. At the time of mounting on the main tank 4, the supply needle 5*a* and the atmosphere guiding needle 5*b* pierce through the rubber plugs 4*b*, 4*c* so that the channel communicating between the inside of the main tank 4 and the supply needle 5*a*, the atmosphere guiding needle 5*b* is provided.

In the main tank 4, the supply needle 5*a* is inserted to the lower part, and a pipe 4*d* elongating upward from the rubber plug 4*b* is provided. In the pipe 4*d*, a plurality of through holes 4*e*1 to 4*e*7 are formed in the circumference facing with each other, with the upper end opened. The pipe 4*d* will be explained later.

The ink supply unit 5 is provided with a channel 5*d* communicating with the ink supply tube 6, a blocking valve 10 for blocking the ink supply to the channel 5*d*, and a channel 5*c* elongating from the supply needle 5*a* to the blocking valve 10 such that the blocking valve 10 can be opened or closed selectively.

The atmosphere guiding needle 5*b* communicates with the atmosphere via the channel 5*e*, the atmosphere communicating chamber 5*f*, and the atmosphere communicating opening 5*g*.

The inner diameter of the supply needle 5*a*, and the atmosphere guiding needle 5*b* is set at a large value of $\phi 1.6$ (mm) for restraining the ink flow resistance.

The blocking valve 10 opens or closes the channel by vertically moving a rubber material diaphragm 10*a*. The central part of the diaphragm 10*a* is pressured from above by a spring 10*c* via a spring holder 10*b* so that the opening of the channel 5*d* can be closed by the lower surface of the diaphragm 10*a*. Thereby, the channel blocking state can be provided.

A flange 10*f* is provided in the upper part of the spring holder 10*b*. The flange 10*f* is engaged with the point of application of a rotatable lever 10*d*. The lever 10*d* has the power point contacted with the link 7*b* interlocked with the recovery unit 7 to be described later so as to lift up the diaphragm 10*a*, resisting to the pressuring force of the spring 10*c* in the case it is pushed by the link 7*b* so as to have the channel 5*c* and the channel 5*d* in the communicating state.

The blocking valve 10 is in the opened state when the recording head ejects the ink, and in the closed state when it is in the stand by or pose state. It will execute the opening or closing operation by the timing of the recovery unit 7 at the time of filling the ink to be described later.

The above-mentioned ink supply unit 5 and main tank 4 configuration is provided for the inks of each color of the black, the cyan, the magenta and the yellow. The supply needle 5*a*, the atmosphere guiding needle 5*b*, the channels 5*c*, 5*d*, 5*e*, the blocking valve 10, and the atmosphere communicating chamber 5*f* are provided integrally in the ink supply unit 5. The lever 10*d* of the blocking valve 10 is provided one each for the all inks. The flange 10*f* of the spring holder 10*b* in the blocking valve 10 of each color ink engages with the point of application of the lever 10*d* so that the blocking valves for each color are opened or closed at the same time.

In the case the recording head 1 consumes the ink, the ink is sent each time from the main tank 4 to the recording head 1 by the negative pressure. At the time, the same amount of the air as the ink is guided from the atmosphere guiding opening 5*g* to the main tank 4 via the atmosphere communicating needle 5*b*.

The atmosphere communicating chamber 5*f* temporarily stores the ink pushed out by the air expansion in the main tank 4. In the case the air in the main tank 4 is expanded by the circumferential environment temperature is raised while the ink jet recording apparatus is in the stand by or pause state, the ink 9 in the main tank 4 flows out from the atmosphere communicating needle 5*b* to the atmosphere communicating chamber 5*f* via the channel 5*e*. In contrast, in the case the environment temperature is lowered, the air in the main tank 4 is contracted so that the ink flown out into the atmosphere communicating chamber 5*f* returns to the main tank 4. Moreover, in the case a printing operation is executed in a state with the ink entered in the atmosphere communicating chamber 5*f*, first the ink in the atmosphere communicating chamber 5*f* returns to the main tank 4, and when the ink in the atmosphere communicating chamber 5*f* is run out, the air is guided to the main tank 4 as usual. In the case the capacity of the atmosphere communicating chamber 5*f* is insufficient, the ink is leaked out from the atmosphere communicating opening. Therefore, by ensuring the capacity of the atmosphere communicating chamber 5*f* in consideration of the maximum ink flow out amount in a range of the apparatus use environment temperature, the ink leakage can be prevented.

The air maximum expansion volume in the main tank 4 is the expansion volume to have the equal volume as the tank capacity at the maximum temperature. The volume obtained by subtracting the air volume in the main tank 4 at the lowest temperature from the maximum expansion volume is the capacity required for the atmosphere communicating chamber 5*f*.

An inverse U shaped part 5*k* is provided in the channel elongating from the atmosphere communicating chamber 5*f* to the atmosphere communicating opening 5*g*. The inverse U shaped part 5*k* is disposed at a position higher than the upper end opening of the supply needle 5*a*. In the case the inverse U shaped part 5*k* is not provided, if the main tank 4 storing the ink 9 is mounted without mounting the recording head 1 inadvertently and the blocking valve 10 is opened, the air is guided from the supply needle 5*a* into the main tank 4. Then, the top end of the supply needle 5*a* has the atmospheric pressure so that the ink flows to the lower part so as to be leaked out from the atmosphere communicating opening 5*g*. That is, according to the inverse U shaped part 5*k*, the ink leakage can be prevented even in the case an operation error of having the inside of the main tank 4 at the atmospheric pressure is generated.

The supply needle 5*a* and the atmosphere communicating needle 5*b* of the ink supply unit 5 are connected with a detection circuit 5*h* for measuring the electric resistance of the ink 9 for detecting existence or absence of the ink in the main tank 4.

In the case the ink 9 is present in the main tank 4, the supply needle 5*a* and the atmosphere communicating needle 5*b* are conducted electrically (closed). In the case the ink is absent or the tank is not mounted, it is blocked electrically (opened). In the case the opened state is detected, the detection circuit 5*h* transmits a predetermined signal to a control unit (not shown). Since the detection electric current is minute, the insulation property between the supply needle 5*a* and the atmosphere communicating needle 5*b* is important. In this embodiment, the channel elongating from the supply needle 5*a* to the recording head 1, and the channel elongating from the atmosphere communicating needle 5*b* to the atmosphere opening 5*g* are provided completely independent with each other so that the electric resistance of only the ink in the main tank 4 can be measured.

In the case the main tank 4 is detached, similar to the case of the ink absence state, the supply needle 5*a* and the atmosphere communicating needle 5*b* are in the opened state. At the time, it is judged to be the ink absence, and a signal showing the printing impossible state is transmitted to the control unit.

Next, the configuration of the inside of the main tank 4 will be explained.

The through holes 4*e*1 to 4*e*7 of the pipe 4*d* are disposed zigzag by a predetermined pitch (L1 to L6) along the axis direction of the pipe 4*d*. The pitches L1 to L6 are set at the equal pitch or the unequal pitch.

The cross sectional shape of the pipe 4*d* is provided as for example a round shape, but as long as it has a predetermined cross sectional area (to be described later) or more, various kinds of shapes such as elliptic, polygonal, abnormal, or the like can be adopted.

The size of the through holes 4*e* are set such that the flow amount of the through holes 4*e* becomes equal in consideration of the pipe inside tube path friction, the enlarged or reduced tube pressure loss, the through hole height (head), or the like. The cross sectional shape of the through holes 4*e* is provided as for example, a round shape, however, a counter bore shape having a tapered surface on the through hole outer side opening end (pipe outer circumference side opening end), or the like can also be adopted for reducing the channel resistance. As long as it is a hole capable of having the equal flow amount, a polygonal or abnormal shape can be used as well.

The upper end opening part height of the pipe 4*d* is provided upper than the ink liquid level 9*a* at the time the main tank 4 is filled with the ink by the maximum amount, and the uppermost part through hole 4*e*7 position is provided at a position slightly lower than the liquid level 9*a*. The position of the lowermost part through hole 4*e*1 is at the same height as the main tank bottom surface. According to the configuration, the ink stagnation in the main tank 4 can be reduced as much as possible so that the ink can be used up without waste.

As to the through hole 4*e* arrangement, various arrangements such as arranging on one side of the pipe 4*d* spirally along the pipe 4*d* circumference, or the like. However, in either arrangement, it is preferable that the number of the through holes and the through hole pitch L are set according to the precipitation degree of the ink 9 (the volume ratio of the thick ink at the time of the precipitation).

In the case the ink liquid level is lower than the second through hole 4*e*2, since the ink is supplied only from the lowermost through hole 4*e*1, the through hole size ϕd1 of the through hole 4*e*1 should be a size without causing a trouble such as the bubble generation due to the supply insufficiency. According to the experiment, the through hole size ϕd1 needs to be ϕ1 mm or more. In this embodiment, the thorough hole size of the through holes 4*e*1 to 4*e*7 is set at ϕ1 mm to 3 mm.

The inner diameter ϕD of the pipe 4*d* should be a size without bridging the bubbles in the pipe (bubble choking). The bridge characteristic depends on the surface tension and the viscosity of the ink 9. For example, when the user mounts the main tank 4 on the ink supply unit 5 after shaking the same, or the like, the bubbles are trapped in the pipe so that the ink supply is stagnated.

According to the experiment, in order to prevent bridging, the pipe cross sectional area needs to be 20 $mm^2$ or more. In this embodiment, in consideration of the margin of the ink viscosity irregularity, or the like, ϕD=ϕ8 mm. Gradual enlargement of the pipe cross sectional area from the lowermost part toward the upper end opening part is preferable in that not only it can be peeled off from the mold at the time of pipe molding, but also the channel resistance of the pipe length can be alleviated so that the through hole size setting allowance range can be widened. Moreover, thereby, since the hole size ϕd1 of the lowermost part through hole 4*e*1 can be made larger, the bubble generation by the supply insufficiency to be described later can also be alleviated so that the ink from the through holes can be agitated in the pipe, and thus it is effective in terms of homogenizing the density. As to the taper angle, it is preferably about 1 to 5 degrees.

According to the configuration, even in the case the above-mentioned precipitation is generated by leaving the tank, the substantially same flow amount of the inks flows from the entire area of the upper layer part, the middle layer part and the lower layer part of the main tank into the pipe 4*d* so as to be supplied from the supply needle 5*a* while being agitated in the pipe 4*d* in a state with the density homogenization.

In order to sufficiently agitate in the pipe 4*d* with a small ink flow amount, the inner diameter ϕD of the pipe 4*d* should be made small as much as possible so that it is provided preferably at the lower limit value with the margin added in a range without the bubble bridge generation.

In FIG. 12, the experiment for confirming the density homogenization effect by the pipe 4*d* was executed by the following conditions.

That is, the following density distribution measurement was executed with a pipe 4*d* inner diameter ϕD=ϕ8 mm, an inner diameter ϕd1 to d7 of the through holes 4*e*1 to e7 of ϕ1 mm to 3 mm, and a pitch L1 to L6 of 15 to 20 mm.

For both of the main tank 4 provided with the pipe 4*d* and the main tank 4 without providing the pipe 4*d*, the experiment by the procedures (1) to (4) was executed for twice each.

(1) With the inside of the main tank 4 filled with 250 cc of pure water W, 10 cc of a raw ink 20 (black ink) was injected slowly from the atmosphere communicating needle 5*b* side by an injection cylinder 400, or the like.

(2) The pure water including the raw ink 20 (hereinafter it is referred to as the liquid mixture) was vacuumed from the ink supply needle 5*a* by the vacuuming pump 21 for accelerating the precipitation of the raw ink 20. The flow amount from the ink supply needle 5*a* at the time was set equal to the real ink flow amount of the ink jet recording apparatus.

(3) The liquid mixture vacuumed by the vacuuming pump 21 was sampled by a predetermined timing.

(4) An appropriate amount of the sampled liquid mixture was dropped onto a test paper 22. After leaving and drying, the OD value (density) of the colored surface 23 was measured.

FIG. 13 is a graph with the time plotted in the lateral axis, and the OD value in the vertical axis. In the graph, the experiment result for the main tank 4 provided with the pipe

4*d* is shown by the graphs A1 (black triangle plot) and A2 (x plot), and the experiment result for the main tank 4 without providing the pipe 4*d* is shown by the graphs A3 (black round plot) and A4 (black square plot).

While the density is homogeneous in the graphs A1, A2, the density is drastically lowered in the graphs A3, A4. Thereby, the density homogenizing effect of the pipe 4*d* can be observed apparently.

In FIG. 11, the recovery unit 7 has a vacuuming cap 7*a* to be raised toward to the ejecting nozzle 1*g* at a position facing the ejecting nozzle 1*g*. The vacuuming cap 7*a* is driven vertically by the cam 7*b*. The vacuuming cap 7*a* made of a rubber material covers and closes tightly the nozzle surface of the ejecting nozzle 1*g* at the time of being raised, and it is moved to a position withdrawn from the recording head 1 at the time of being lowered. The cam 7*b* is driven by the cam controlling motor 7*g*.

The vacuuming cap 7*a* is connected with the vacuuming pump 7*c* such that the ink or the air is vacuumed from the inside of the vacuuming cap 7*a* according to the drive of the pump motor 7*d*. The vacuuming pump 7*c* is of the tube pump method having a plurality of rollers. It can vacuum continuously, and it can adjust the vacuuming amount according to the rotation speed of the pump motor. The maximum vacuuming pressure of the vacuuming pump 7*c* is set at for example 0.4 atm.

The cam controlling motor 7*g* is interlocked with the cam 7*f* for driving the link 7*e* such that the link 7*e* is driven, interlocked with the vertical movement of the vacuuming cap 7*a* so as to rotate the lever 10*d*. Thereby, the blocking valve 10 is opened or closed, interlocked with the vacuuming cap 7*a*.

The cam controlling motor 7*g* rotates and drives the cams 7*b*, 7*f* in the arrow Cd direction concentrically. The cams 7*b*, 7*f* set the vacuuming cap 7*a*, the blocking valve 10 at the positions a, b, c of FIG. 1 at a predetermined state. At the position "a", both the vacuuming cap 7*a* and the blocking valve 10 are in the opened state, at the position "b", both the vacuuming cap 7*a* and the blocking valve 10 are in the closed state, and at the position c, the vacuuming cap 7*a* is in the closed state and the blocking valve 10 is in the opened state.

At the time of the image recording operation, the cams 7*b*, 7*f* are set at the position "a" so as to open the vacuuming cap 7*a* and the blocking valve 10 for enabling the ink ejection and the ink supply.

During the apparatus stopping and stand by period, the cams 7*b*, 7*f* are set at the position "b" so as to cover the nozzle surface of the recording head 1 by the vacuuming cap 7*a* for preventing drying of the ejecting nozzle 1*g*. At the time, the blocking valve 10 is closed so that the ink flow out by the apparatus movement, the apparatus inclination, or the like is prevented.

At the position "b" state of the cams 7*b*, 7*f*, the ink charging operation is executed by the recovery unit 7. At the time of the ink charging operation, the carriage 2 is moved in the main scanning direction, and the recording head 1 is moved to a position facing the vacuuming cap 7*a*. Next, the cam controlling motor 7*g* of the recovery unit 7 is driven so that the cam 7*b* and the cam 7*f* are rotated to the position "b". Then, the vacuuming cap 7*a* is in a state of covering and closely closing the nozzle surface of the recording head 1, and the blocking valve 10 closes the ink channel. Next, in the case the pump motor 7*d* is driven for executing the vacuuming operation of the vacuuming pump 7*c*, the ink and the air stagnating in the recording head 1 is vacuumed out through the ejecting nozzle 1*g* so that the pressure inside the recording head 1 is reduced. The vacuuming operation of the vacuuming pump 7*c* is continued until it reaches at a predetermined pressure (predetermined vacuuming amount), obtained by the calculus or the experiment. At the time the vacuuming pump 7*c* is stopped, the cam controlling motor 7*g* is driven so as to rotate the cam 7*b* and the cam 7*f* to the position c, and the blocking valve 10 is opened. Then, the ink flows into the recording head 1 with the reduced pressure so that the sub tank 1*b* and the liquid chamber 1*f* are filled with the ink. The ink amount to be filled is the volume necessary at the time of returning the pressure of the chambers with the reduced pressure substantially to the atmospheric pressure, and it is determined by the volume and the pressure of the chambers. The ink charging operation is completed in about 1 second after opening the blocking valve 10.

When the ink charging operation is completed, the cam controlling motor 7*g* is driven so as to rotate the cams 7*b*, 7*f* to the position "a", and the vacuuming cap 7*a* is opened so as to discharge the ink remaining in the vacuuming cap 7*a* by the vacuuming pump 7*c*. Since the blocking valve 10 is in the opened state at the time, the image can be recorded, however, in the case there is no image recording command, the cam controlling motor 7*g* is driven again so as to rotate the cams 7*b*, 7*f* to the position "b" for being in the stand by state.

Embodiment 4

Next, a fourth embodiment of the ink jet recording apparatus according to the present invention will be explained with reference to the drawings.

Figure 14:
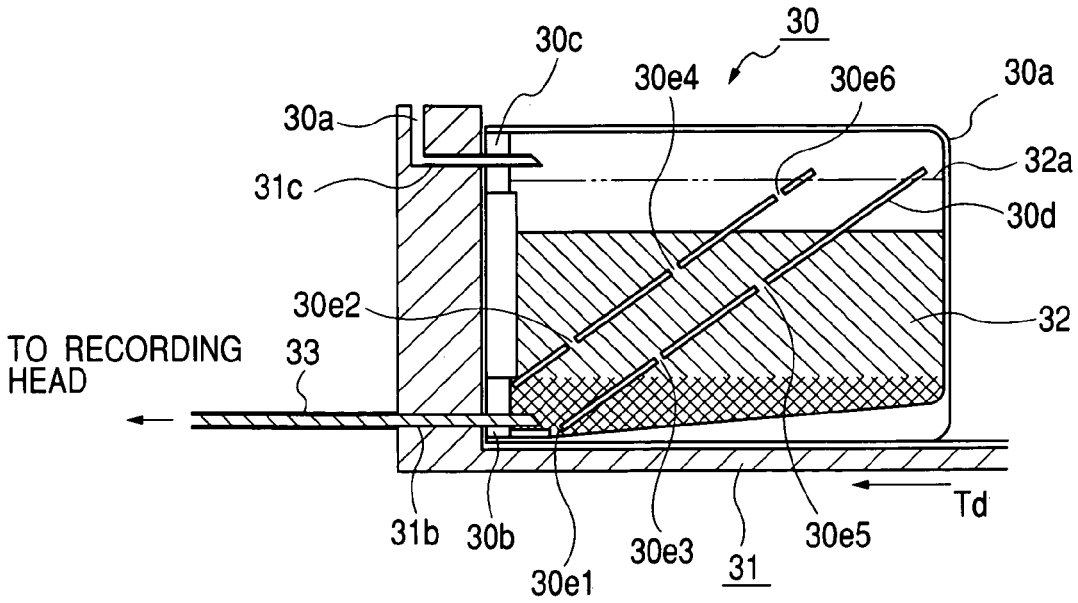
FIG. 14 is a vertical sectional view showing the main tank of the ink supply system in a fourth embodiment of the ink jet recording apparatus according to the present invention.

FIG. 14 is a vertical sectional view showing the main tank of the ink supply system in the fourth embodiment. The same numerals are provided for the same or corresponding parts as in the third embodiment, and explanation is omitted here.

In FIG. 14, as in the third embodiment, the main tank 30 comprising a rigid case 30*a* provided with two rubber plugs 30*b*, 30*c* in the lower part, is detachable with respect to the ink supply unit 31. The main tank 30 is a sealed container as a single body for storing the ink 32 as a liquid. The main tank 30 is mounted on the ink supply unit 31 by being slid in the arrow Td direction (horizontal direction) in the figure.

In the upper part of the ink supply unit 31, the atmosphere communicating opening 31*a* is formed, with the atmosphere communicating opening 31*a* communicating with the hollow atmosphere guiding needle 31*c*. The supply needle 31*b* is provided in the lower part of the ink supply unit 31, with the supply needle 31*b* communicating with the recording head 1 via the ink supply tube 33.

At the time of mounting on the main tank 30, the supply needle 31*b* and the atmosphere guiding needle 31*c* pierce through the rubber plugs 30*b*, 30*c* so that the channel communicating between the inside of the main tank 30 and the supply needle 30*b*, the atmosphere guiding needle 30*c* is provided.

The pipe 30*d* elongating obliquely upward from the rubber plug 30*b* is provided inside the main tank 4, and the supply needle 30*b* is opened toward the inside of the pipe 30*d* in the lower part of the pipe 30*d*.

In the pipe 30*d*, a plurality of through holes 30*e*1 to 30*e*7 are formed in the circumference facing with each other, with the upper end opened. As in the third embodiment, the through hole size of the through holes 30*e* is set such that the flow amounts can be equal.

As in the third embodiment, the height of the upper end opening part of the pipe 30*d* is higher than the ink liquid level 32*a* at the time of filling the main tank 30 with the maximum amount of the ink, and the position of the uppermost part through hole 30*e*6 is at a position slightly lower than the liquid level 32*a*. The position of the lowermost part through hole 30*e*1 is at the substantially same height as the main tank bottom surface. The bottom part of the main tank 30 is an inclined surface having a predetermined angle toward the rubber plug 30*b*. According to the configuration, the ink stagnation in the main tank 30 can be reduced as much as possible so that the ink can be used up without waste.

As in the third embodiment, the through hole size ϕd1 of the lower most part through hole 4*e*1 should be a size without causing a trouble in the supply even in the case the ink residual amount becomes small, and the pipe 30*d* inner diameter should be a size without bridging the bubbles in the pipe (bubble choking).

According to the fourth embodiment, as in the third embodiment, even in the case the above-mentioned precipitation is generated by leaving the tank, the substantially same flow amount of the inks flow from each through hole 30*e* from the entire area of the upper layer part, the middle layer part and the lower layer part of the main tank into the pipe 30*d* so as to be supplied from the supply needle 30*b* while being agitated in the pipe 30*d* in a state with the density homogenization.

Recently, according to the high speed printing, the large recording paper size, the continuous operation property, or the like, a large capacity is required for the main tank. Although the operativity of the large capacity main tank tends to be lowered due to the weight increase, according to the configuration of the second embodiment of mounting the main tank 30 by sliding, it can be mounted with a small operation force so that a high operativity can be achieved.

What is claimed is:

1. A liquid storage container comprising a liquid storage part for storing a liquid, a connection part for taking out the liquid, provided in a bottom part of the liquid storage part, and a pipe provided in the liquid storage part so as to cover an opening of the connection part on a side of the liquid storage part, wherein a plurality of liquid inlet holes are formed in the pipe, each inlet hole communicating with the liquid storage part at a plurality of positions in the vertical direction, and an inlet resistance of the liquid inlet holes disposed in a lower layer area on a bottom part side out of the plurality of the liquid inlet holes of the pipe is larger than the inlet resistance of the other liquid inlet holes.

2. The liquid storage container according to claim 1, wherein the lower layer area has a content density thicker than the initial density at the time the content of the liquid in the liquid storage part is precipitated according to the time passage.

3. The liquid storage container according to claim 1, wherein an opening area of the liquid inlet hole provided in the vertical direction lowermost position out of the plurality of the liquid inlet holes is smaller than an opening area of the other liquid inlet holes.

4. The liquid storage container according to claim 1, wherein the pipe elongates in the vertical direction from the liquid storage part to the height substantially equal to the height in the liquid storage part, and the plurality of the liquid inlet holes are disposed successively upward from the bottom part of the pipe or the vicinity thereof in the vertical direction in a posture with the liquid storage container mounted in a recording apparatus.

5. The liquid storage container according to claim 1, wherein an inner cross sectional area of the pipe is 20 $mm^2$ or more.

6. The liquid storage container according to claim 1, wherein an inner cross sectional area of the vertical direction lowermost part of the pipe is smaller than the inner cross sectional area of the vertical direction uppermost part.

7. A recording apparatus for recording on a recording medium using a liquid, comprising:

a liquid storage container comprising a liquid storage part for storing a liquid, a connection part for taking out the liquid, provided in a bottom part of the liquid storage part, and a pipe provided in the liquid storage part so as to cover an opening of the connection part on a side of the liquid storage part; and recording means for ejecting the liquid in the liquid storage container;

wherein a plurality of liquid inlet holes are formed in the pipe of the liquid storage container, each inlet hole communicating with the liquid storage part at a plurality of positions in the vertical direction, and an inlet resistance of the liquid inlet holes disposed in the lower layer area on a side of the bottom part out of the plurality of the liquid inlet holes of the pipe is larger than the inlet resistance of the other liquid inlet holes.

* * * * *